US010342310B1

(12) United States Patent
Kutting

(10) Patent No.: US 10,342,310 B1
(45) Date of Patent: Jul. 9, 2019

(54) HANDBAG ORGANIZER INSERT

(71) Applicant: Life in Play Company, LLC, Los Gatos, CA (US)

(72) Inventor: Lauren H. Kutting, Los Gatos, CA (US)

(73) Assignee: Life in Play Company, LLC, Los Gatos, CA (US)

( * ) Notice: Subject to any disclaimer, the term of this patent is extended or adjusted under 35 U.S.C. 154(b) by 0 days.

(21) Appl. No.: 15/790,840

(22) Filed: Oct. 23, 2017

Related U.S. Application Data

(63) Continuation of application No. 29/600,938, filed on Apr. 17, 2017, which is a continuation of application No. 29/507,405, filed on Oct. 27, 2014, now Pat. No. Des. 784,020.

(51) Int. Cl.

| | |
|---|---|
| ***A45C 9/00*** | (2006.01) |
| ***A45C 13/02*** | (2006.01) |
| *A45C 7/00* | (2006.01) |
| *A45C 3/06* | (2006.01) |

(52) U.S. Cl.
CPC ..... *A45C 13/02* (2013.01); *A45C 3/06* (2013.01); *A45C 7/0086* (2013.01); *A45C 2013/026* (2013.01)

(58) Field of Classification Search
CPC .. A45C 3/06; A45C 3/00; A45C 13/02; A45C 1/024; A45C 1/02
USPC ..... 150/100, 112, 104, 105; 190/107, 108, 190/110, 111; 206/579, 581; D3/305, D3/315
See application file for complete search history.

(56) References Cited

U.S. PATENT DOCUMENTS

| | | | | |
|---|---|---|---|---|
| 2,620,005 A | | 2/1950 | Hall | |
| 2,675,042 A | * | 4/1954 | Herrera | A45C 13/02 150/106 |
| 2,937,728 A | * | 5/1960 | Koffler | A45C 3/12 190/110 |
| 4,182,391 A | * | 1/1980 | Kjose | A63B 55/40 224/581 |
| 4,263,951 A | * | 4/1981 | Siegel | A45C 3/06 150/106 |
| 4,506,769 A | * | 3/1985 | Franco | A45C 3/00 16/DIG. 40 |
| D286,230 S | | 10/1986 | Cohen et al. | |
| 4,718,524 A | * | 1/1988 | Crumley | A45C 3/00 150/113 |
| D391,081 S | | 2/1998 | Godshaw | |

(Continued)

OTHER PUBLICATIONS

Life in Play Diaper Bag Alternative—The Jacquie, Black posted at diapers.com; posting date not given; [visited site on Apr. 6, 2016] Available from Internet at: <URL: http://www.diapers.com/p/life-in-play-diaper-bag-alternative-the-tejal-brown-1182403.html>.

*Primary Examiner* — Fenn C Mathew
*Assistant Examiner* — Cynthia F Collado
(74) *Attorney, Agent, or Firm* — Aka Chan LLP

(57) ABSTRACT

A handbag organizer insert is a functional, organized way to transform an existing purse or handbag into a kid-friendly, take anywhere, fully functional diaper bag. The user has the option to turn an everyday purse into a diaper bag. Just insert the organizer into the bag or purse for instant compartments for everything that is needed on-the-go for the user and the baby. The depth of the organizer can be adjusted to fit different size bags.

27 Claims, 26 Drawing Sheets

(56) References Cited

U.S. PATENT DOCUMENTS 5,845,780 A * 12/1998 Allen ..... A45C 3/00 206/579
D403,863 S 1/1999 Briganti
D408,146 S 4/1999 Briganti
6,176,356 B1 * 1/2001 Powley ..... A45C 7/0095 190/1
6,179,025 B1 1/2001 Sutton
6,237,660 B1 5/2001 Giardino
D443,764 S 6/2001 Salz
D445,256 S 7/2001 Lentz
6,283,183 B1 9/2001 Cooper
6,296,094 B1 * 10/2001 Knecht ..... A45C 7/0095 190/107
D460,622 S 7/2002 Wong
6,561,240 B2 5/2003 Ma
D483,181 S 12/2003 Evans
6,823,909 B1 11/2004 Marsteller
D524,544 S 7/2006 Crook
D575,513 S 8/2008 Siegel
D595,957 S 7/2009 Meyers
D600,918 S 9/2009 Carlevale
D606,743 S 12/2009 Meyers
D608,543 S 1/2010 Sammons
D609,002 S 2/2010 Sammons
D609,473 S * 2/2010 Boonma ..... D3/318
D615,759 S 5/2010 Evans
D621,620 S 8/2010 Alessandri
8,225,829 B2 7/2012 Melamed
8,251,113 B2 * 8/2012 Baxter ..... A45C 1/024 150/103
8,267,130 B1 9/2012 Sinnett
D692,653 S 11/2013 Platt et al.
8,950,450 B2 * 2/2015 Hedaya ..... A45C 3/08 150/104
D723,806 S 3/2015 Salmon
D732,294 S 6/2015 Hu
D732,829 S 6/2015 Johnson et al.
D733,432 S 7/2015 Johnson et al.
D750,891 S 3/2016 Lank
9,289,040 B2 * 3/2016 Appleton ..... A45C 3/06
2003/0116243 A1 6/2003 Cooper
2003/0164216 A1 * 9/2003 Starr ..... A45C 3/08 150/105
2006/0096680 A1 5/2006 Khubani et al.
2006/0096681 A1 5/2006 Khubani et al.
2006/0283680 A1 12/2006 Hollin et al.
2007/0044877 A1 3/2007 Davidoff et al.
2008/0156604 A1 7/2008 Franco et al.
2011/0031081 A1 * 2/2011 Iceberg ..... A45C 3/001 190/125
2011/0036473 A1 2/2011 Chan et al.
2013/0201666 A1 8/2013 Melamed
2014/0224390 A1 8/2014 Nikakhtar

* cited by examiner

HANDBAG ORGANIZER INSERT

CROSS-REFERENCE TO RELATED APPLICATIONS

This application is a continuation of U.S. patent application Ser. No. 29/600,938, filed Apr. 17, 2017, which is a continuation of U.S. patent application Ser. No. 29/507,405, filed Oct. 27, 2014, issued as U.S. Pat. No. D784,020 on Apr. 18, 2017. These applications are incorporated by reference along with all other references cited in this application.

BACKGROUND OF THE INVENTION

Traditional diaper bags are typically not fashionable and not available through popular brand name fashion designers. There is not a good selection of diaper bag designs and styles. Diaper bag moms typically carry a bulky diaper bag in addition to a purse or handbag which can be difficult to carry and manage.

There is a need for a better way to carry baby's essentials, especially a new handbag organizer insert that can fit right into mom's already stylish bag.

BRIEF SUMMARY OF THE INVENTION

A handbag organizer insert is a functional, organized way to transform an existing purse or handbag into a kid-friendly, take anywhere, fully functional diaper bag. The user has the option to turn an everyday purse into a diaper bag. Just insert the organizer into the bag or purse for instant compartments for everything that is needed on-the-go for the user and the baby. The depth of the organizer can be adjusted to fit different size bags.

A specific implementation of a handbag organizer insert is the Handbag Organizer for Moms product by Life in Play (LP).

The handbag organizer insert boasts features not seen in any other purse organizers. These features include: an insulated pocket, key clasp, changing mat, notebook or tablet pocket, "dirty" pocket and many other multifunctional pockets for organization. In a specific implementation, the organizer has 11 pockets for organization.

For example, with the organizer, the user can carry the following list of items in her tote bag in an organized way: 10 diapers, 2 bottles, changing mat (included), 5 pacifiers, 1 large pack of baby wipes, a notebook, a cell phone, wallet, glasses, snacks, sippy cup, and keys.

Not all organizers are created equal. LP's Handbag Organizer for Mom was created with parents in mind. Every feature acts to simplify you day and ensure the user does not have to compromise style for function.

In a specific implementation, the organizer fits into a bag that is at least about 14 inches wide at the bottom of the bag, at least about 10.5 inches tall, and at least about 3 inches deep.

In a specific implementation, the organizer includes various pockets and compartments including: an insulated baby bottle pocket to keep milk and formula at the right temperature, a special "dirty" pocket to keep used diapers and soiled clothing separate from other items, an easily accessible cell phone pocket, a specialty compartment to keep papers flat, and a quick-access key clasp, or any combination of these. In another specific implementation, the organizer includes a changing mat.

The organizer is made of durable and water resistant material that easily wipes clean. In a specific implementation, the organizer includes a durable nylon twill material that easily wipes clean and does not wear from everyday use.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
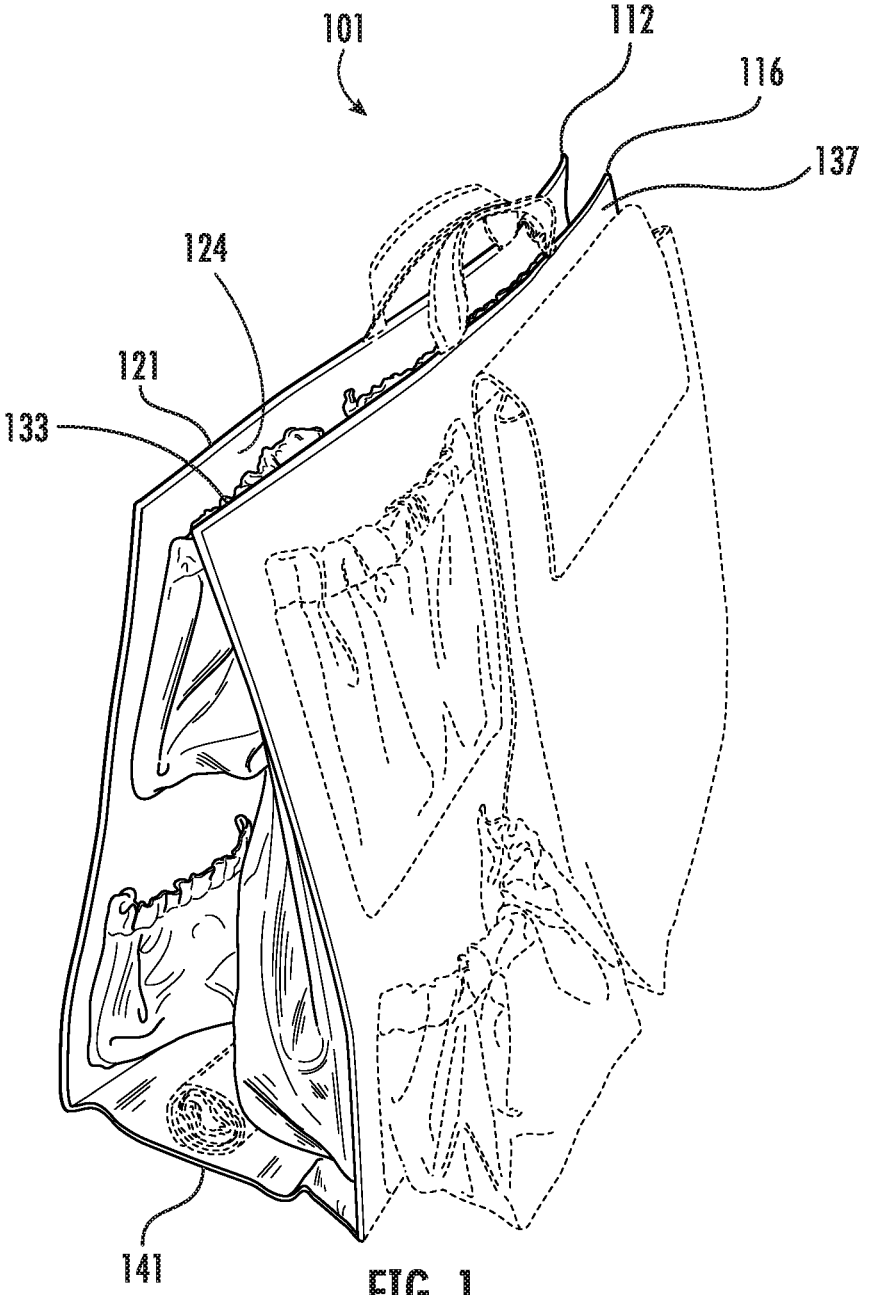
FIG. 1 shows a front perspective view of a handbag organizer insert.
Figure 2:
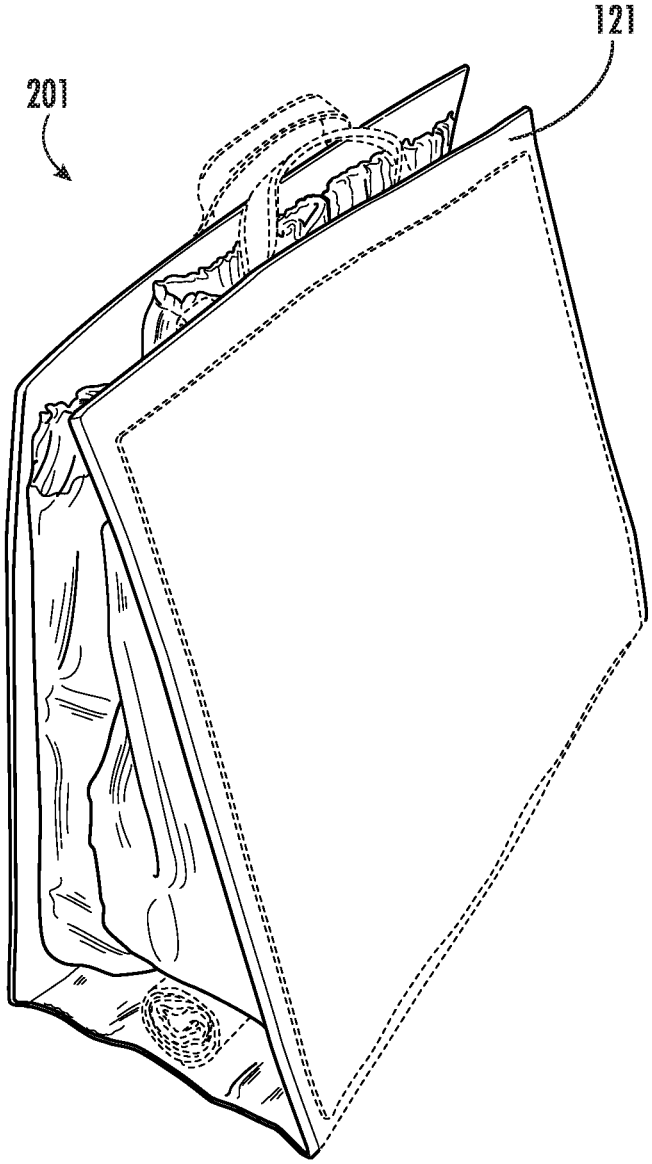
FIG. 2 shows a back perspective view of the handbag organizer insert.
Figure 3:
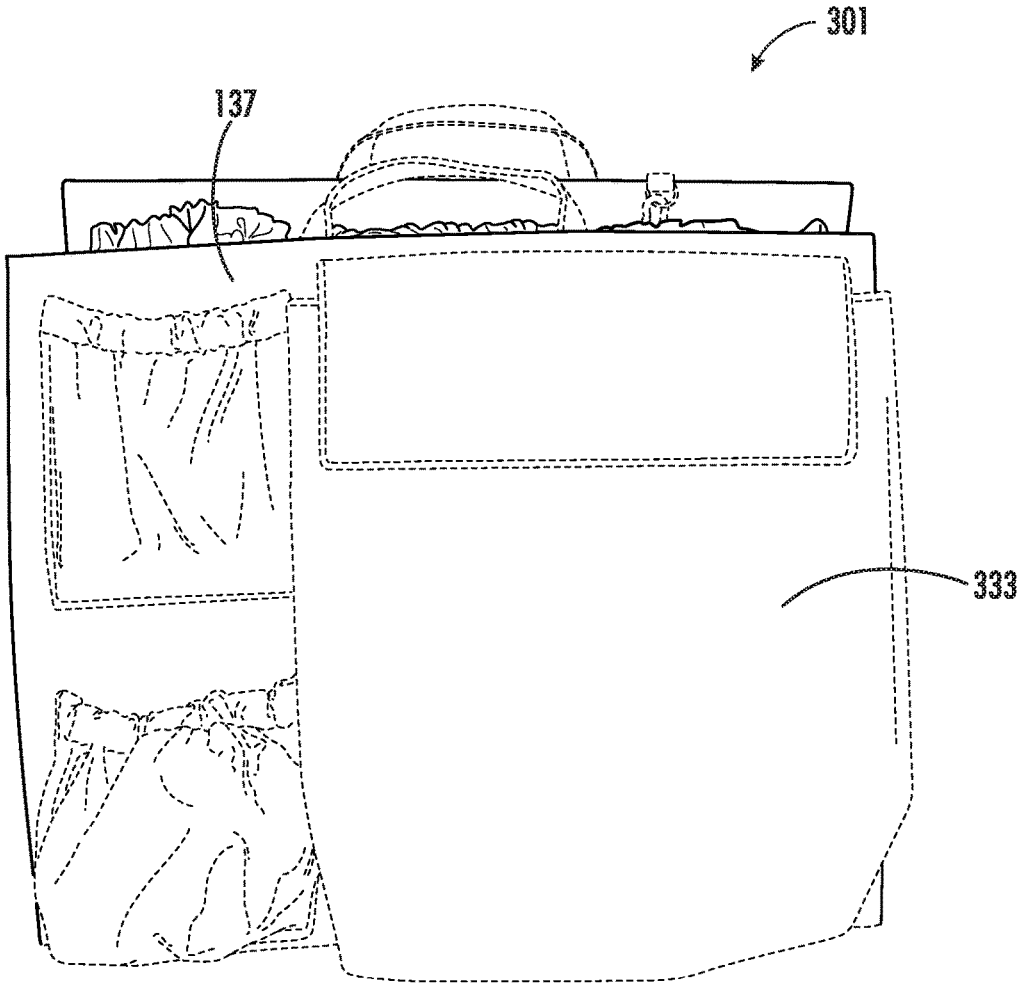
FIG. 3 shows a front view of the handbag organizer insert.
Figure 4:
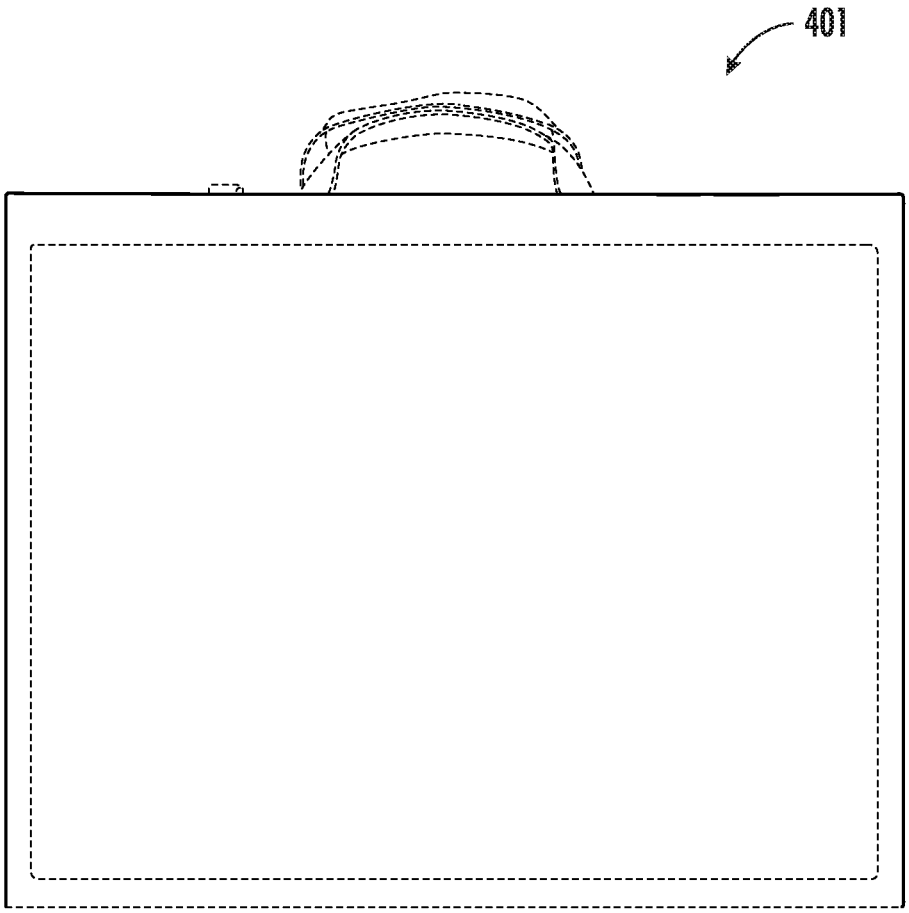
FIG. 4 shows a back view of the handbag organizer insert.
Figure 5:
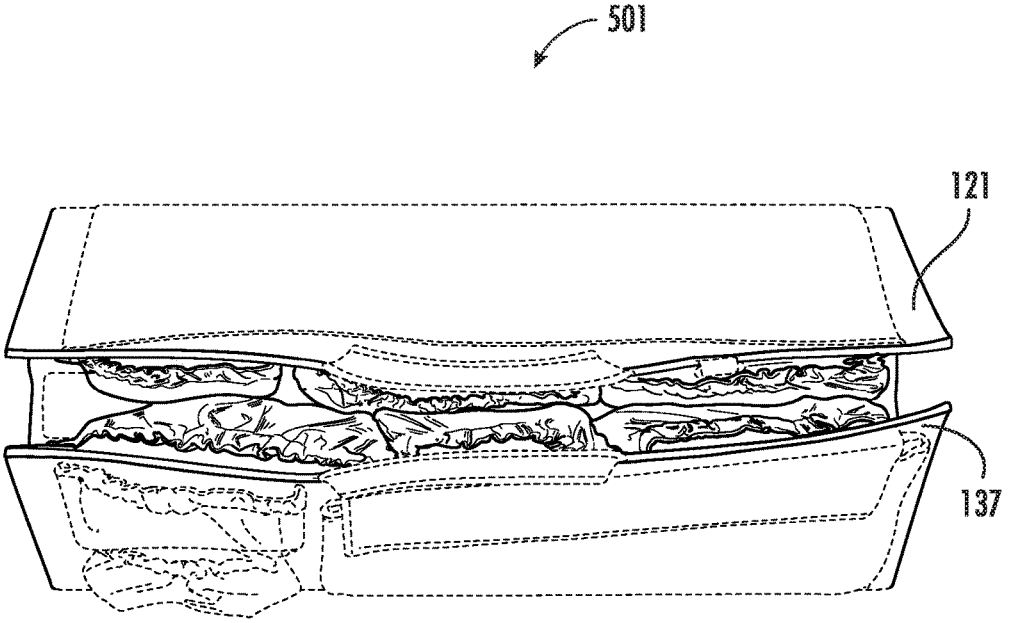
FIG. 5 shows a top view of the handbag organizer insert.
Figure 6:
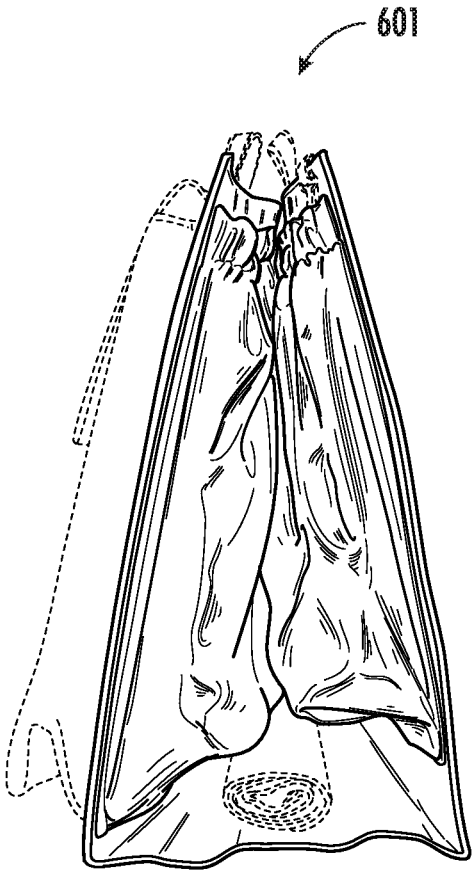
FIG. 6 shows a right-side view of the handbag organizer insert.
Figure 7:
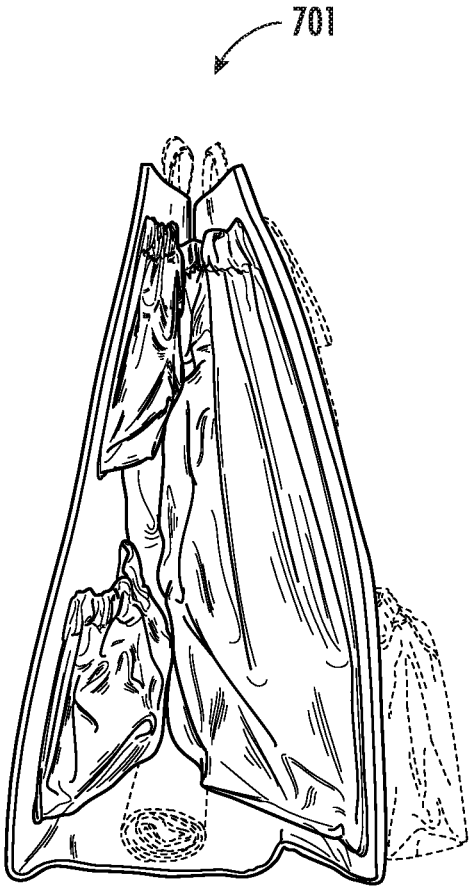
FIG. 7 shows a left-side view of the handbag organizer insert.

FIGS. 1-11 show various views of a handbag organizer insert. FIG. 1 shows a front perspective view 101 of a handbag organizer insert. FIG. 2 shows a back perspective view 201 of the handbag organizer insert. FIG. 3 shows a front view 301 of the handbag organizer insert. FIG. 4 shows a back view 401 of the handbag organizer insert. FIG. 5 shows a top view 501 of the handbag organizer insert. FIG. 6 shows a right-side view 601 of the handbag organizer insert. FIG. 7 shows a left-side view 701 of the handbag organizer insert.

Figure 8:
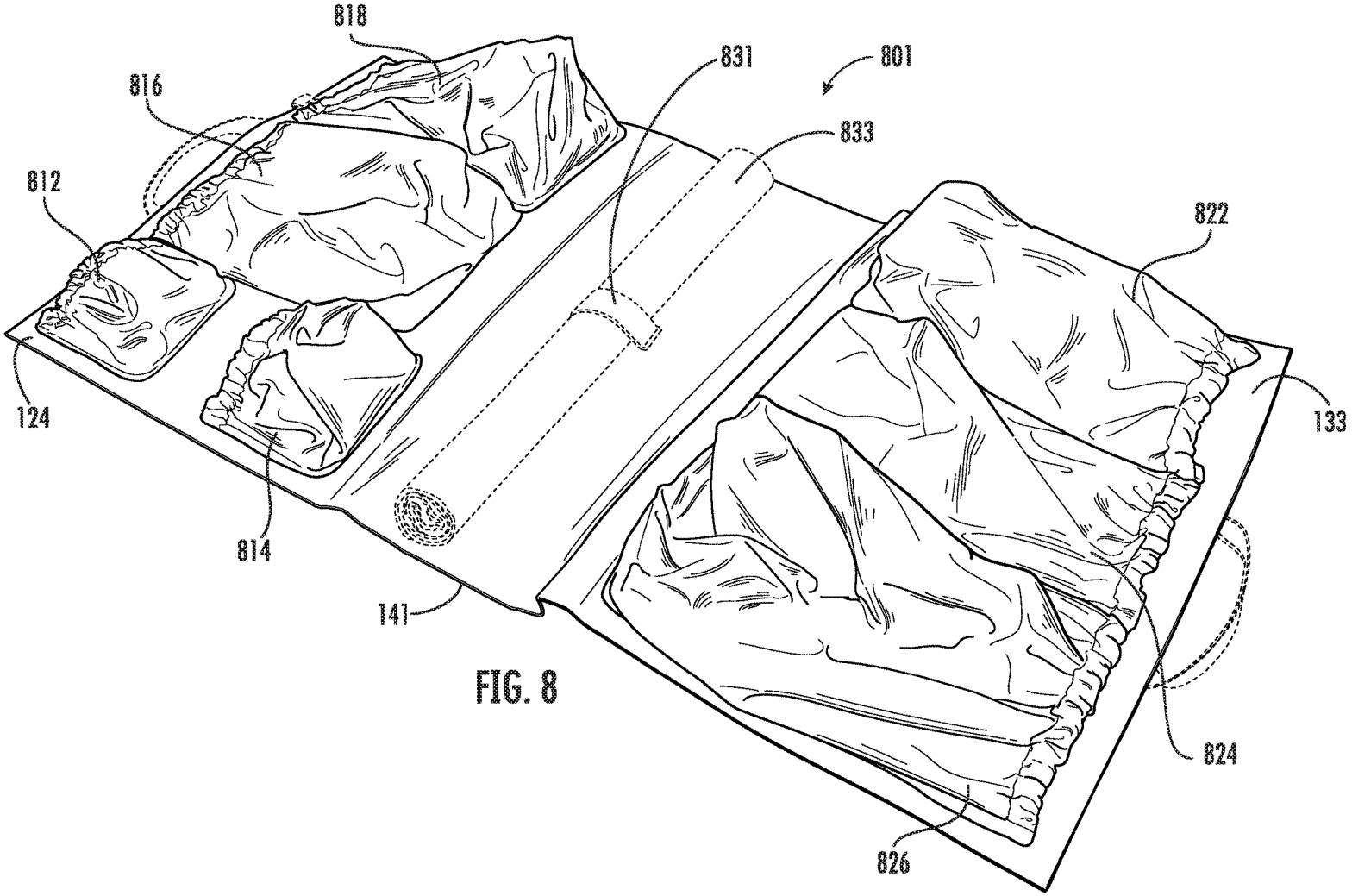
FIG. 8 shows a perspective view of the handbag organizer insert in an open position.
Figure 9:
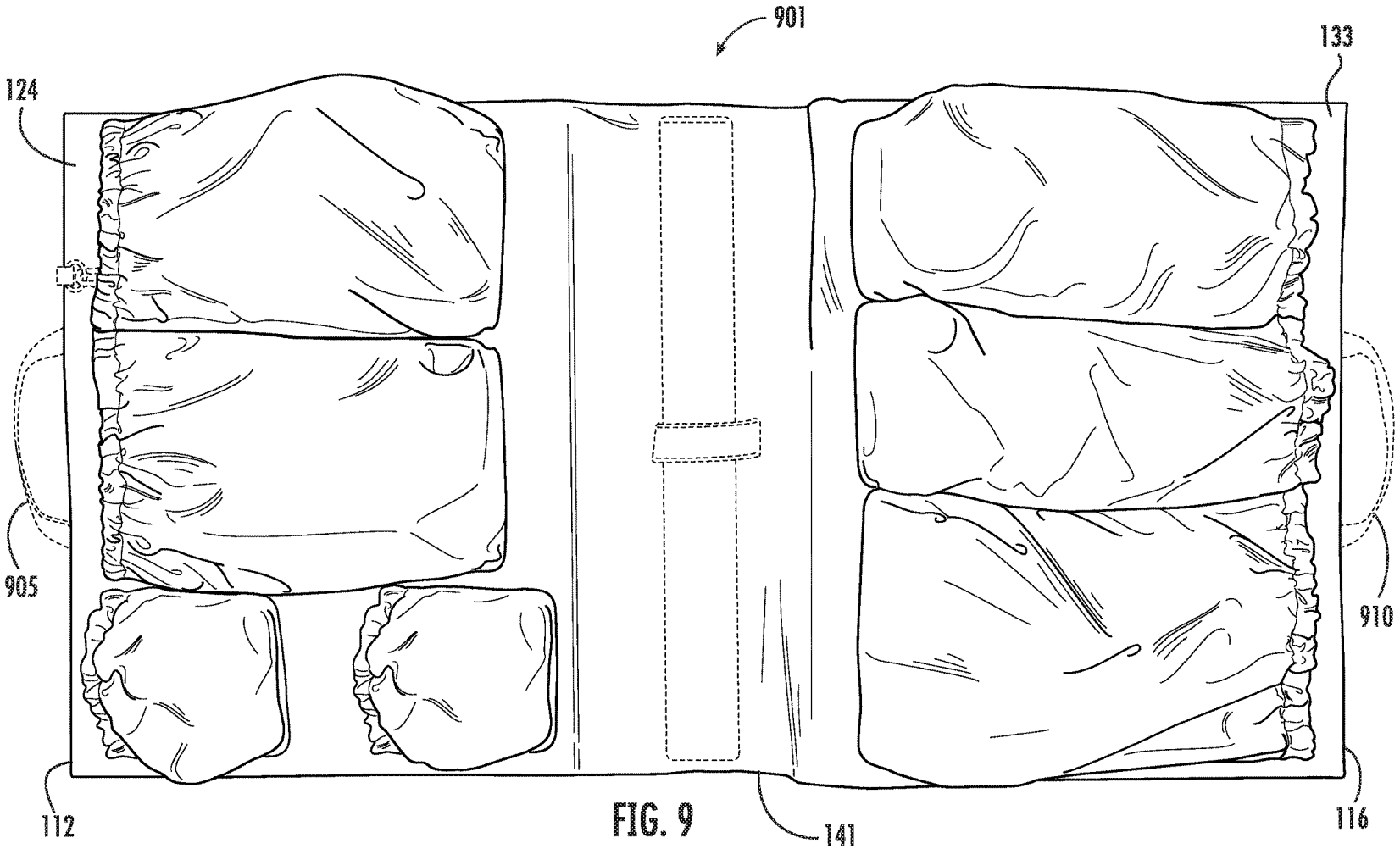
FIG. 9 shows a top view of the handbag organizer insert in the open position.

FIG. 8 shows a perspective view 801 of the handbag organizer insert in an open position. FIG. 9 shows a top view 901 of the handbag organizer insert in the open position.

Figure 10:
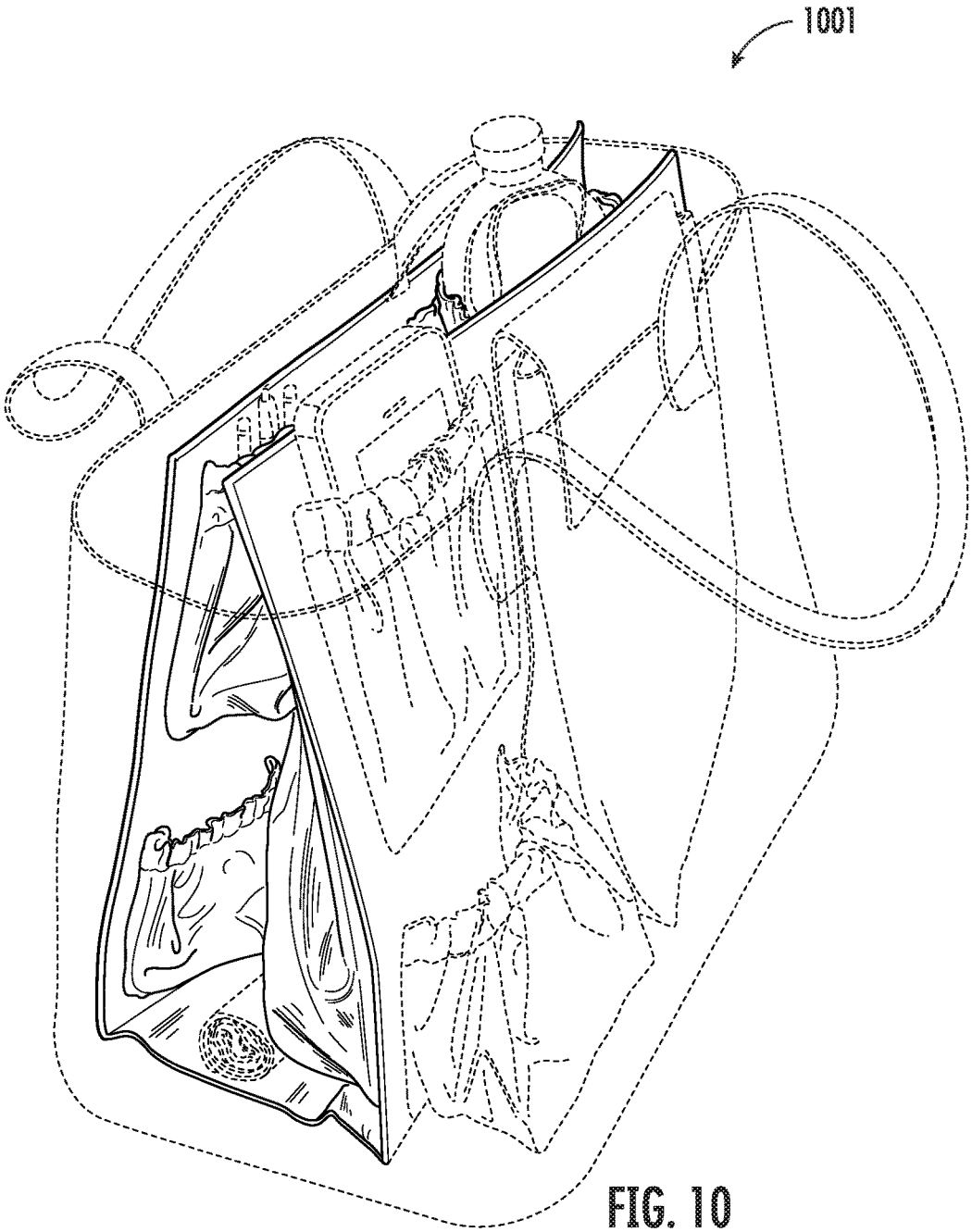
FIG. 10 shows a perspective view of the handbag organizer insert in use in a handbag, where the handbag is presented using a see-through view.
Figure 11:
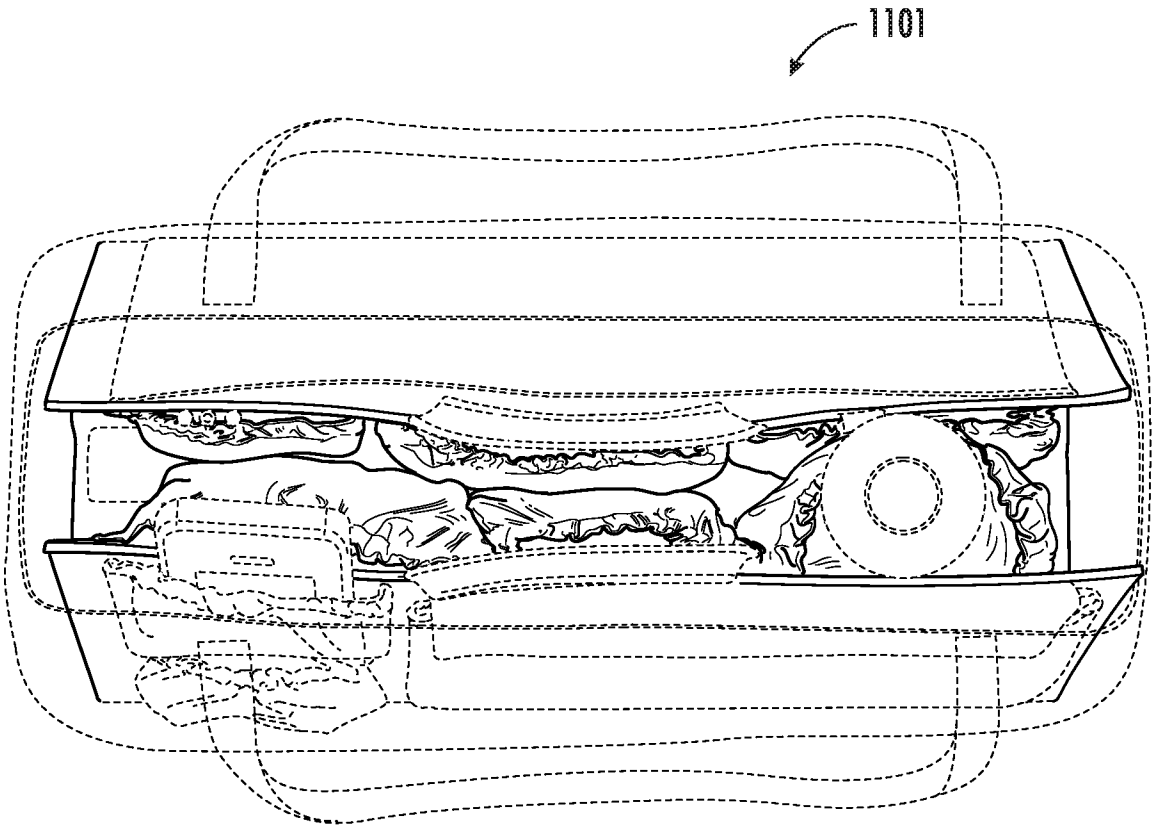
FIG. 11 shows a top view of handbag organizer insert in use in a handbag, where the handbag is presented using a see-through view.

FIG. 10 shows a perspective view 1001 of the handbag organizer insert in use in a handbag, where the handbag is presented using a see-through view. FIG. 11 shows a top view 1101 of handbag organizer insert in use in a handbag, where the handbag is presented using a see-through view.

In FIGS. 1-10, the handbag organizer insert includes a first panel 112 and second panel 116. The first panel includes a first material and a first surface 121 and a second surface 124, and the first and second surfaces include pockets. The second panel includes the first material and a third surface 133 and a fourth surface 137, and the third and fourth surfaces include pockets. There is a flexible base portion 141, where the base portion includes a second material, the second material is more flexible than the first material, and the base portion does not have pockets.

In an open position, via the flexible base portion, the first and second panels can be rotated and positioned in a relatively flat orientation with respect to each other. And while in the open position, the first and second panels can be placed and laid against a relatively flat surface. In an upright position, via the flexible base portion, the first and second panels can be rotated and positioned in a relatively upright orientation with respect to the open position. And while in the upright position, the first and second panels can be inserted into a handbag and are positioned against sides of the handbag while still allowing access to the pockets on first, second, third and fourth surfaces.

In the upright position, the second and third surfaces face each other, while the first and fourth surface face away from each other. Each pocket (e.g., 812, 814, 816, 818) of the second surface of the first panel includes an opening and three closed sides that are connected or attached to the first panel, and the opening is positioned facing away from the base portion. Each pocket (e.g., 822, 824, 826) of the third surface of the second panel includes an opening and three closed sides that are connected or attached to the second panel, and the opening is positioned facing away from the base portion. And while in the upright position in a handbag, the pockets of second and third surfaces can hold an item without that item falling into the base panel, which is positioned against a bottom of the handbag.

The base portion can further include an elastic band holder 831, and the handbag organizer insert includes a mat 833 that is rolled up and inserted into the elastic band holder. Fourth surface 137 can include a first pocket 333 with a flap top, including a hook-and-loop-type closure.

Second surface 124 can include a first pocket 812, second pocket 814, third pocket 816, and fourth pocket 818. The first pocket is positioned above the second pocket. The third pocket is positioned besides the first and second pockets. And a length of the third pocket extends from at least a top of the first pocket to a bottom of the second pocket. In the upright position, the openings of the first pocket, second pocket, and third pocket face way from the base panel and extend along lines parallel to a bottom edge of the first panel that is attached or connected to the flexible base portion.

An upper edge of the first panel can include a first handle 905 and an upper edge of the second panel can include a second handle 910. And when in the upright position, a person's hand can be placed through openings of both the first and second handles.

FIG. 1 shows a perspective view of a specific implementation of a bag organizer. The organizer is made of a nylon material that is water resistant and resistant to spills.

Figure 12A:
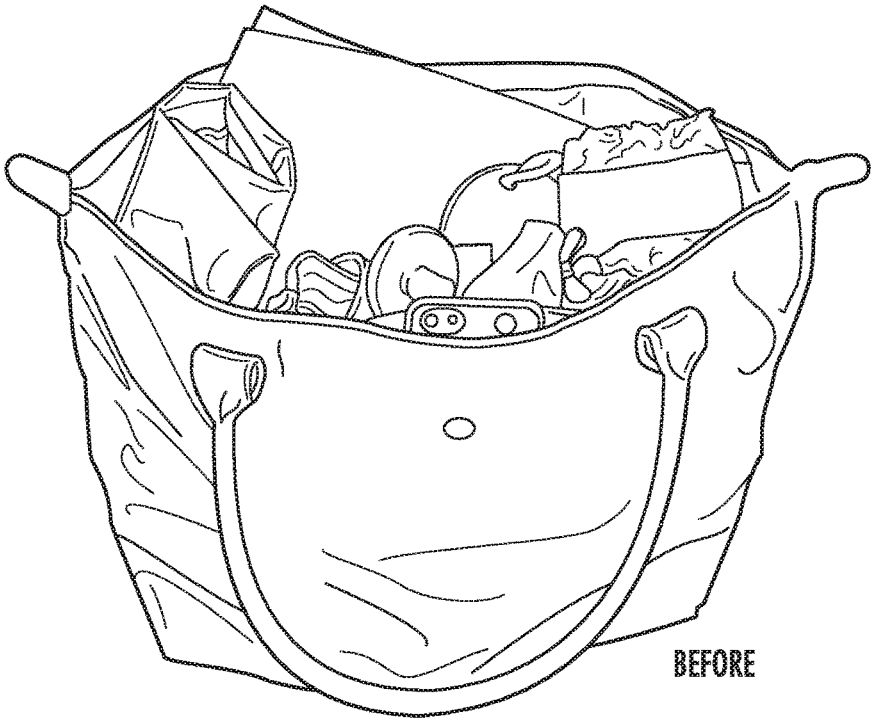
FIG. 12A shows a typical tote bag ("before" view) filled with baby items. The bag is unorganized and unmanageable. In contrast.
Figure 12B:
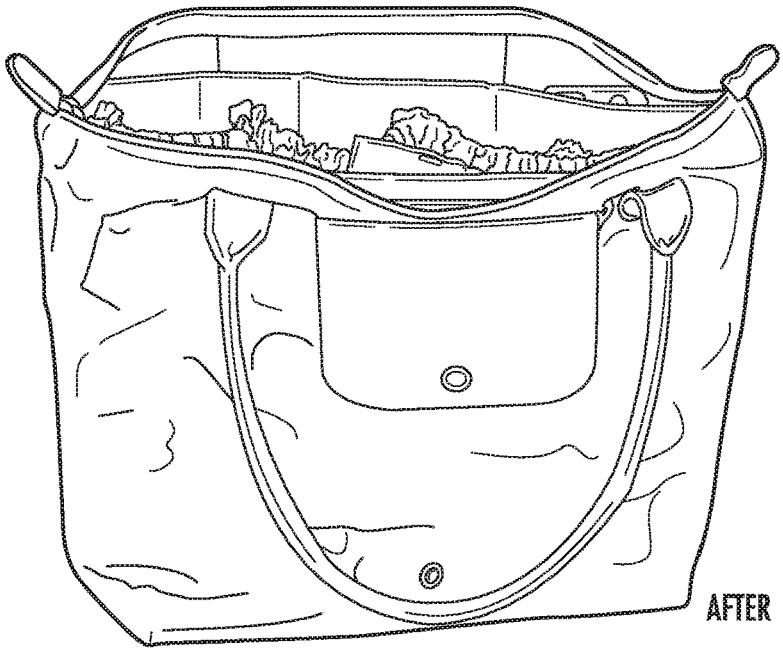
FIG. 12B shows the same bag with an organizer inserted ("after" view) and the baby items are organized and accessible.

FIG. 12A shows a typical tote bag ("before" view) filled with baby items. The bag is unorganized and unmanageable. In contrast, FIG. 12B shows the same bag with an organizer inserted ("after" view) and the baby items are organized and accessible.

Some examples of typical diaper bag items that a mom would carry around include bottle, diapers, change of clothes, wipes, food containers, teething ring, pacifier, snacks, toys, sunglasses, phone, and keys. With the bag organizer insert, these items are organized in multifunctional pockets. The organizer insert can be inserted into a handbag or tote bag of choice, allowing the mom to be organized and stylish all at once.

Figure 13:
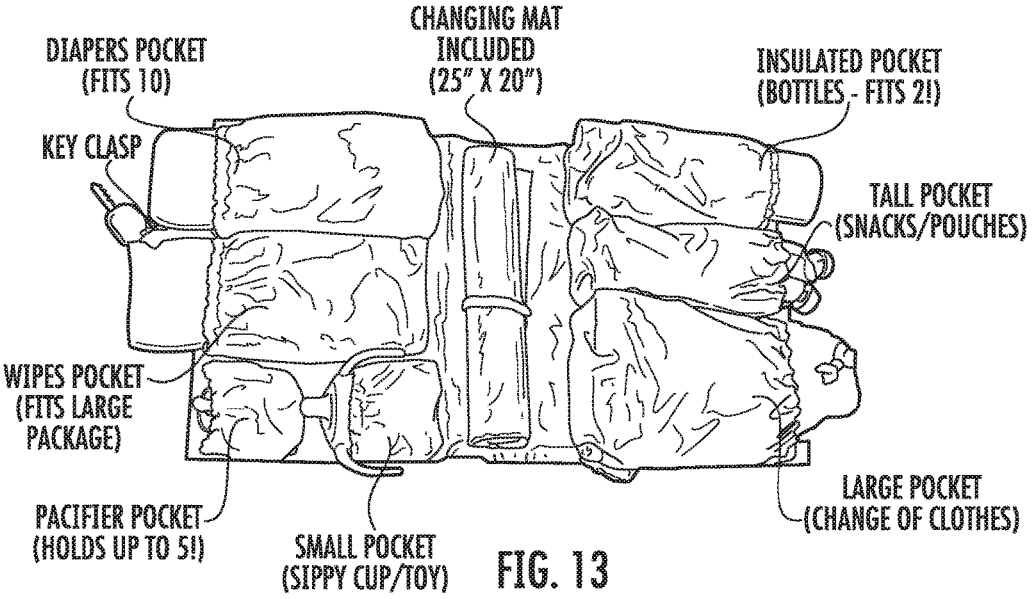
FIG. 13 shows an inside view of another specific implementation of an organizer, opened and laid flat, such as on a table.

FIG. 13 shows an inside view of another specific implementation of an organizer, opened and laid flat, such as on a table. Because the organizer can be opened and laid flat, this allows easier access to loading and removing items from the pockets.

On a first side (e.g., left), there are four pockets and a key holder. These pockets can fit a large package of wipes, up to 10 diapers, up to 5 pacifiers, a sippy cup or a toy, and others. On a second side (e.g., right), there are three pockets. A first insulated pocket can fit up to two bottles. A second pocket can fit snacks and pouches. A third pocket is larger than the first and second pockets and can fit a change of clothes, a blanket, larger toys, or a combination of these. The organizer includes an optional changing mat. In a specific implementation, it can hold a mat of about 25 inches long by 20 inches wide that can be rolled up.

The fabric of the pockets on the first and second sides is gathered at the top, near the opening of the pocket, to hold or help close the pocket or hold items in the pocket. This gathering can be by way of elastic banding (e.g., elastic band in a channel), pleating, folding, shirring (e.g., using elastic thread), ruching, or other sewing or manufacturing techniques. This gathering creates a number of pleats, folds, creases, ridges, corrugation, wrinkles, crinkles, ruffles, bends, ripples, or fluting along the top of the pocket. More detailed views of the gathering for the pocket are shown below in FIGS. 17-19. Other techniques to close or secure the pockets (e.g., to prevent items from falling out) may include Velcro or hook-and-loop fastening, snap buttons, zippers, or flap closures.

In a specific implementation of an organizer, with reference to FIG. 13, on a first side (e.g., left), there are four pockets and a key holder or key fob (e.g., a clip, clasp, carabiner, or ring). In a specific implementation, the key holder includes a split ring with a carabiner type clasp. In another implementation, the key holder includes a carabiner with a swivel attachment to a ring.

These pockets can fit wipes, diapers, a pacifier, a bottle, and other items. On a second side (e.g., right), there are three pockets. These can fit bottles, a wallet, a cell phone, and others. Between the two sides is a bottom panel that will be at the bottom of a handbag. A changing mat is optional, and can be rolled and inserted into an elastic band on this bottom panel for storage. In a specific implementation, the changing mat and elastic band is omitted from the organizer.

Figure 14:
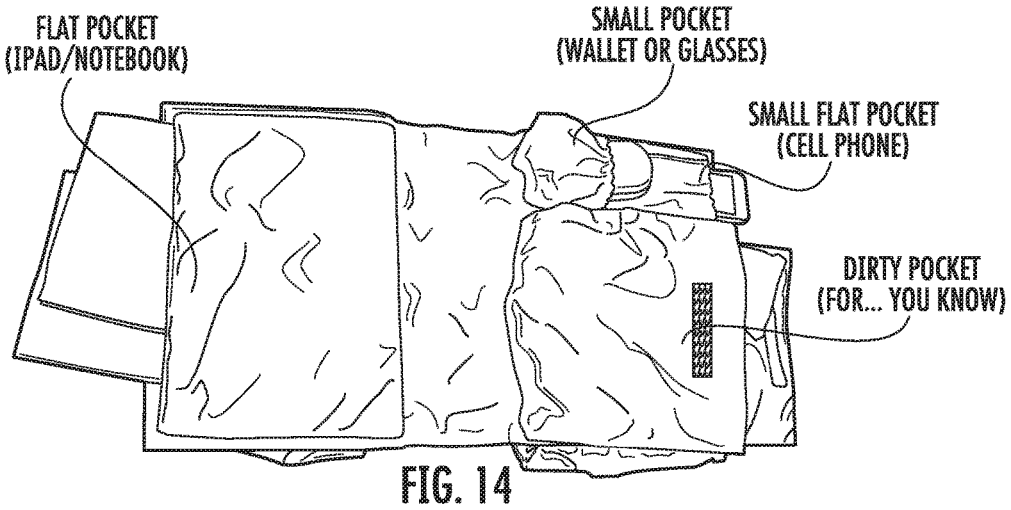
FIG. 14 shows an outside view of a specific implementation of an organizer, opened and laid flat.

FIG. 14 shows an outside view of a specific implementation of an organizer, opened and laid flat. On a first side (e.g., left), there is a large flat pocket for holding paper, notebook, magazine, book, or electronic devices (e.g. iPad, or other tablet device). On a second side (e.g., right), there are three pockets. A first pocket can be used to hold a wallet or glasses. A second pocket can fit a cell phone. A third pocket is larger than the first and second pockets and can be used to hold dirty diapers. This pocket includes a flap with a Velcro closure to provide a stronger seal to keep odors from escaping and used diapers from sliding out. The first and second pockets can have gathered edges (e.g., elastic banded) to prevent items from falling out.

Figure 15:
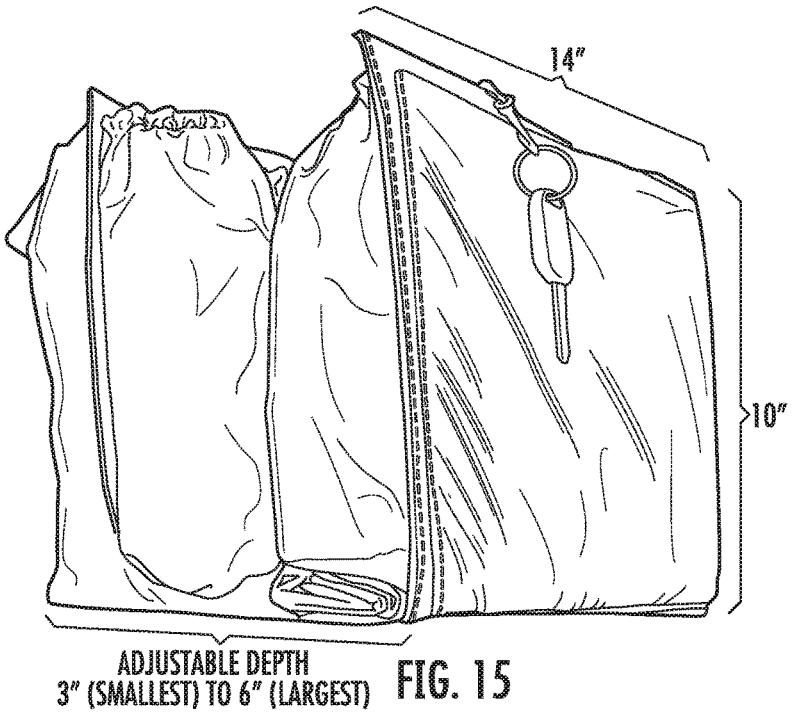
FIG. 15 shows a perspective view of a specific implementation of an organizer.

FIG. 15 shows a perspective view of a specific implementation of an organizer. The organizer is about 14 inches wide, 10 inches tall, and has an adjustable depth in a range from about 3 inches to about 6 inches. The bottom of the organizer is flat. The bottom includes two layers of nylon, while the sides of the organizer have a relatively rigid panel (e.g., plastic or cardboard) sandwiched between the two layers of nylon. The bottom does not have any pockets or handles attached. The relatively rigid panel can act as a divider and gives form or rigidity to the organizer, so that items in the pockets stay in position relative each other and do not knock against each other.

In FIG. 15, the organizer is in a closed or fold-up position, so the left and right sides of the organizer face each other. In this position, the organizer is ready to be inserted into a handbag.

FIG. 11 shows a top view of a specific implementation of an organizer in use in a tote bag. From the top of the tote bag, from a perspective of the user, the organized items are plainly visible, and easily accessible. FIGS. 10-11 show an example of an organizer in use, inside a tote bag.

Some examples of typical diaper bag items that a mom would carry around include bottle, diapers, change of clothes, wipes, food containers, teething ring, pacifier, snacks, toys, sunglasses, phone, and keys. These items can be organized in pockets of the organizer, and inserted into a tote bag.

Some examples of typical diaper bag items that a mom would carry around include bottle, diapers, wipes, food containers, pacifier, snacks, toys, sunglasses, makeup, and keys. With the bag organizer, these items are organized in multifunctional pockets. The organizer can be inserted into a tote bag of choice, allowing the mom to be organized and stylish all at once. The organizer is adapted to fit inside a tote bag, below the top edge, so that the tote bag can be closed or zipped.

Figure 16:
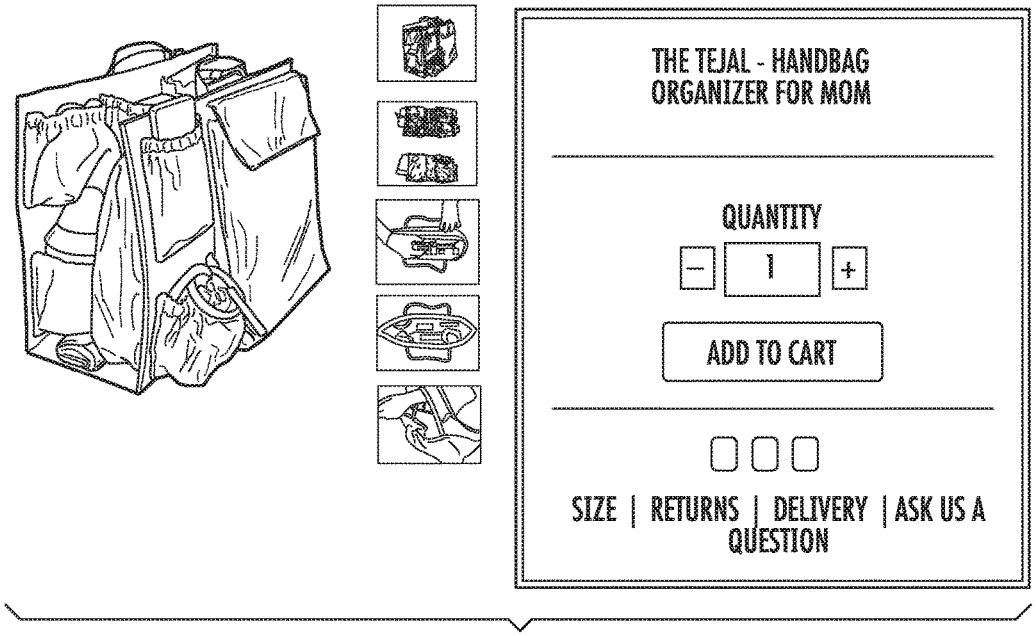
FIG. 16 shows an example of a specific implementation of an organizer for sale on LP's web site.

FIG. 16 shows an example of a specific implementation of an organizer for sale on LP's web site. The organizer includes a base color brown, and an accent color pink. Two inside pockets and an outer flat pocket (not visible) are pink. More details are in FIGS. 13-15 above. The other pockets are brown on an outer surface, and have an inside lining in the accent color, pink. This bag is advertised as the Tejal—Handbag Organizer for Mom.

As another example of a specific implementation of an organizer for sale on LP's web site: The organizer includes a black color durable nylon material. This bag is advertised as the Jacquie—Handbag Organizer for Mom. FIG. 1 shows a perspective view of bag organizer insert; a specific implementation of a bag organizer has black color material.

FIG. 13 shows an inside view of an organizer insert. FIG. 14 shows an outside view of the organizer insert. Referring to FIG. 13, on a first side (e.g., left), there are four pockets and a key holder. These pockets can fit a large package of wipes, up to 10 diapers, up to 5 pacifiers, a sippy cup or a toy, and others. On a second side (e.g., right), there are three pockets. A first insulated pocket can fit up to two bottles. A second pocket can fit snacks and pouches. A third pocket is larger than the first and second pockets and can fit a change of clothes, a blanket, larger toys, or a combination of these.

The organizer includes an optional changing mat. In a specific implementation, it can hold a mat of about 25 inches long by 20 inches wide that can be rolled up. In a specific implementation, the organizer does not have the changing mat and elastic band for holding the mat. The pockets on the first and second sides can have elastic-banded, gathered edges, as described above, to prevent items from falling out.

FIG. 14 shows an outside view of the organizer. On a first side (e.g., left), there is a large flat pocket for holding electronic devices (e.g. iPad, or other tablet device), a notebook, book, and magazines. On a second side (e.g., right), there are three pockets. A first pocket can be used to hold a wallet or glasses. A second pocket can fit a cell phone. A third pocket is larger than the first and second pockets and can be used to hold dirty diapers. This pocket includes a flap with a Velcro closure to provide a stronger seal to keep odors from escaping and used diapers from sliding out. The first and second pockets can have elastic-banded, ruched edges to prevent items from falling out.

FIGS. 10-11 show an example of an organizer in use, inside a tote bag. The organizer is made in a black color to match a black color tote bag.

Some examples of typical diaper bag items that a mom would carry around include bottles, diapers, change of clothes, wipes, food containers, teething ring, pacifier, snacks, toys, and keys for a newborn (about 1 year old and younger). These items can be organized in pockets of the organizer, and inserted into a handbag.

Some examples of typical diaper bag items that a mom would carry around include bottles, diapers, change of clothes, wipes, food containers, bib, pacifier, snacks, toys, and keys for a toddler (between about ages 1 to 3 years old). These items can be organized in pockets of the organizer, and inserted into a handbag.

Some examples of typical items that a mom would carry around include bottle, wipes, food containers, snacks, toys, phone, books, and keys for a school age child (between about ages 2 and a half to 10 years old). These items can be organized in pockets of the organizer, and inserted into a hand bag.

Some examples of typical items that a mom would carry around include bottle, change of clothes, wipes, food containers, snacks, toys, phone, books, and keys for a school age child (between about ages 2 to 10 years old). These items can be organized in pockets of the organizer, and inserted into a hand bag (lower left and right).

FIGS. 10-11 shows an example of an organizer in use, inside a clear tote bag. The pockets of the organizer are visible through the clear sides of the tote bag. As an example, the organizer can be used inside a fashionable tote bag. As an example, a tote bag can be used to hold an organizer.

Figure 17:
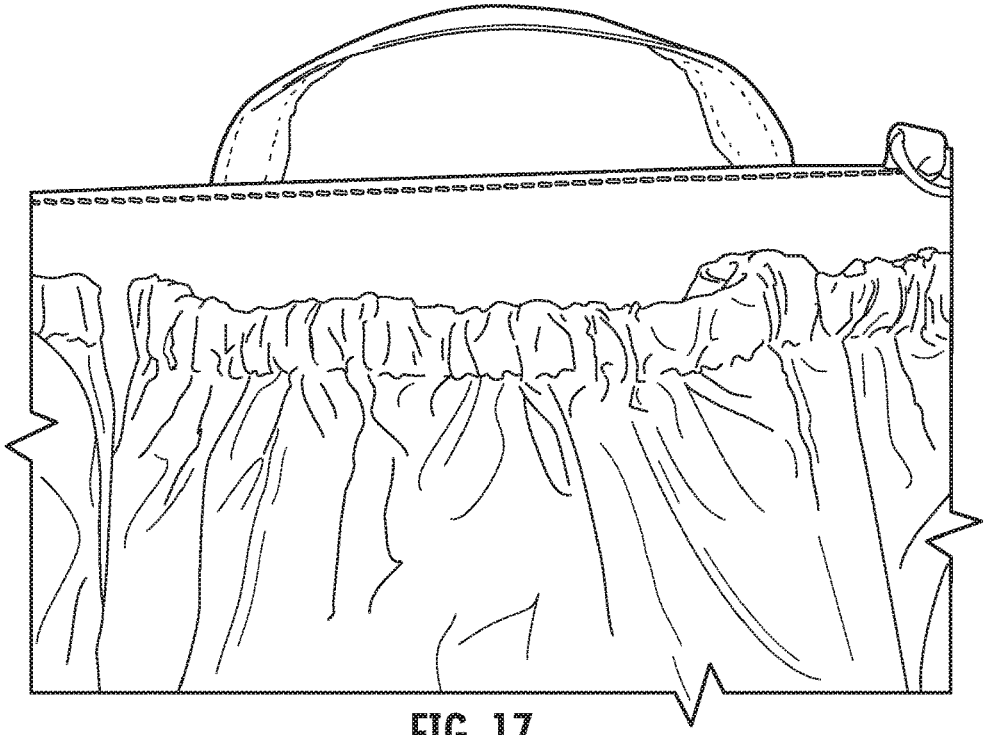
FIG. 17 shows a top of a pocket with a gathered, elastic edge.

FIG. 17 shows a top of a pocket with a gathered, elastic edge. The inner and outer layers of the pocket are gathered along a length of an elastic band or cord that extends in a channel between the inner and outer layers.

Figure 18:
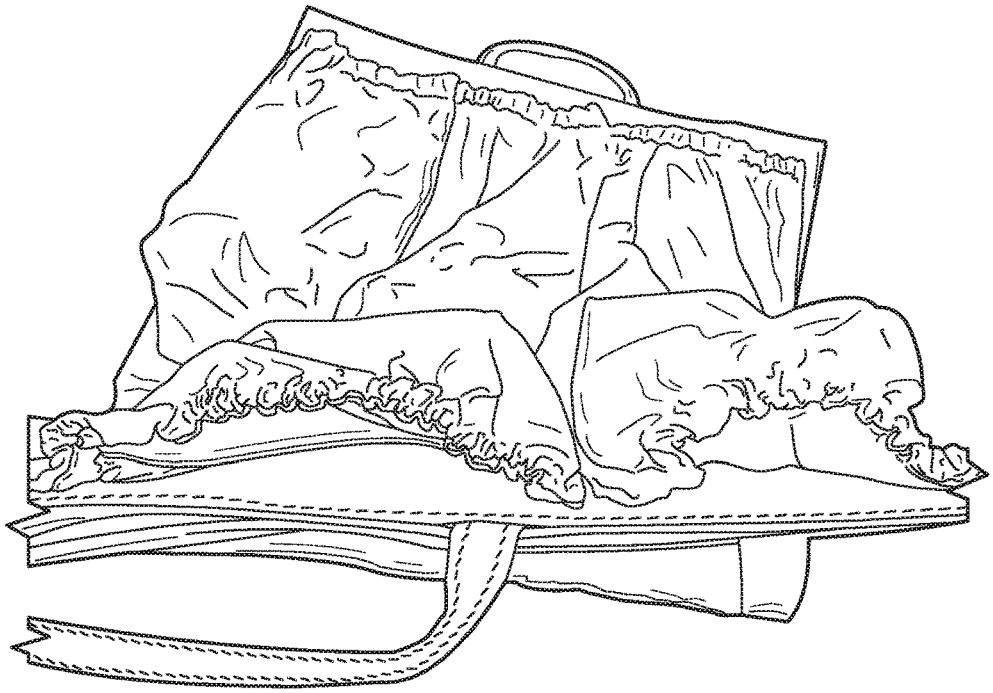
FIG. 18 shows a top edge of the pocket from a top view.

FIG. 18 shows a top edge of the pocket from a top view. The elastic is in an unstretched state. When the elastic is stretched, the gathers of the inner and outer layers of the pocket with extend and become more smooth as the pocket material is pulled.

Figure 19:
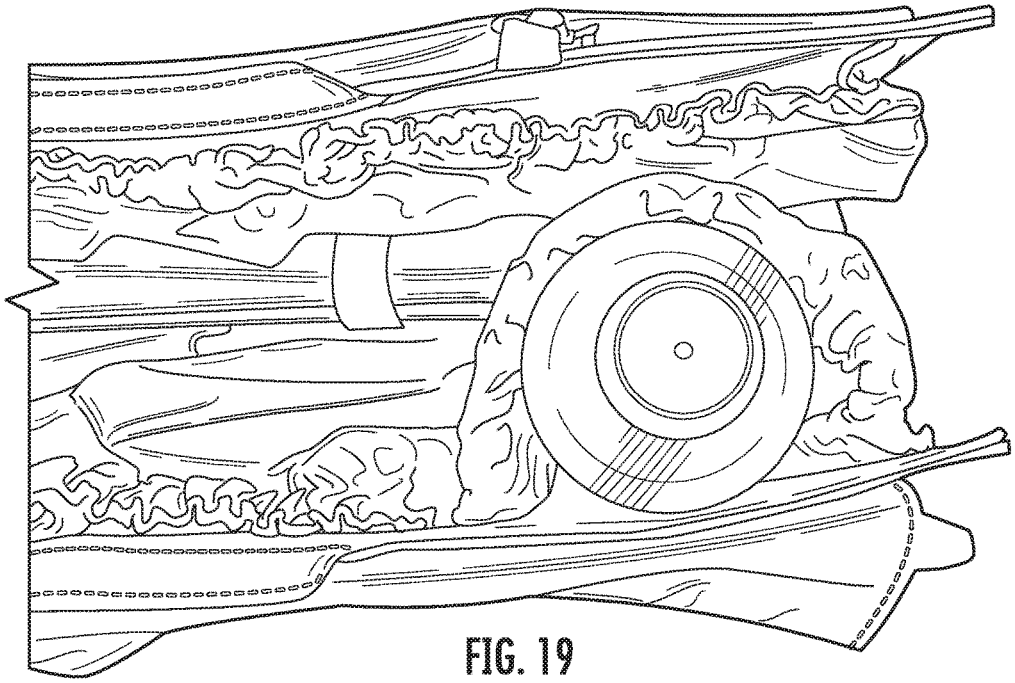
FIG. 19 shows the elastic band in a stretched state, around a water bottle.

FIG. 19 shows the elastic band in a stretched state, around a water bottle. The elastic edge grips to the sides of the bottle, holding it in place in the pocket.

Figure 20:
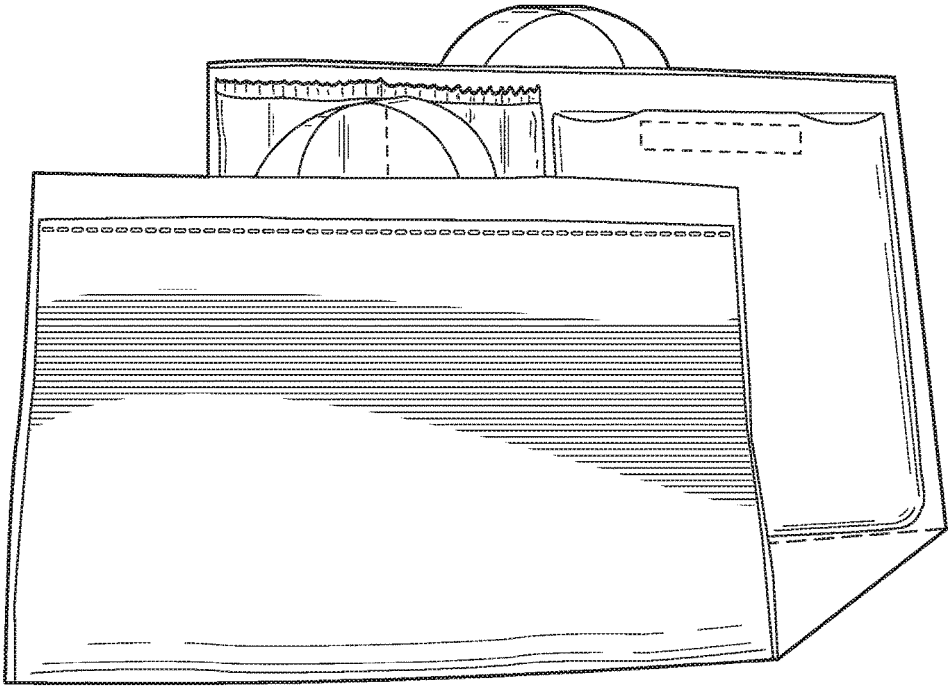
FIG. 20 shows a specific implementation of a handbag organizer insert having pockets on an inside of a first panel of the insert and a pocket on an outside of a second panel.

FIG. 20 shows a specific implementation of a handbag organizer insert having pockets on an inside of a first panel of the insert and a pocket on an outside of a second panel. The pockets can have different types of closures including elastic gathered edges, Velcro tabs, zippers, magnets, and others.

Figure 21:
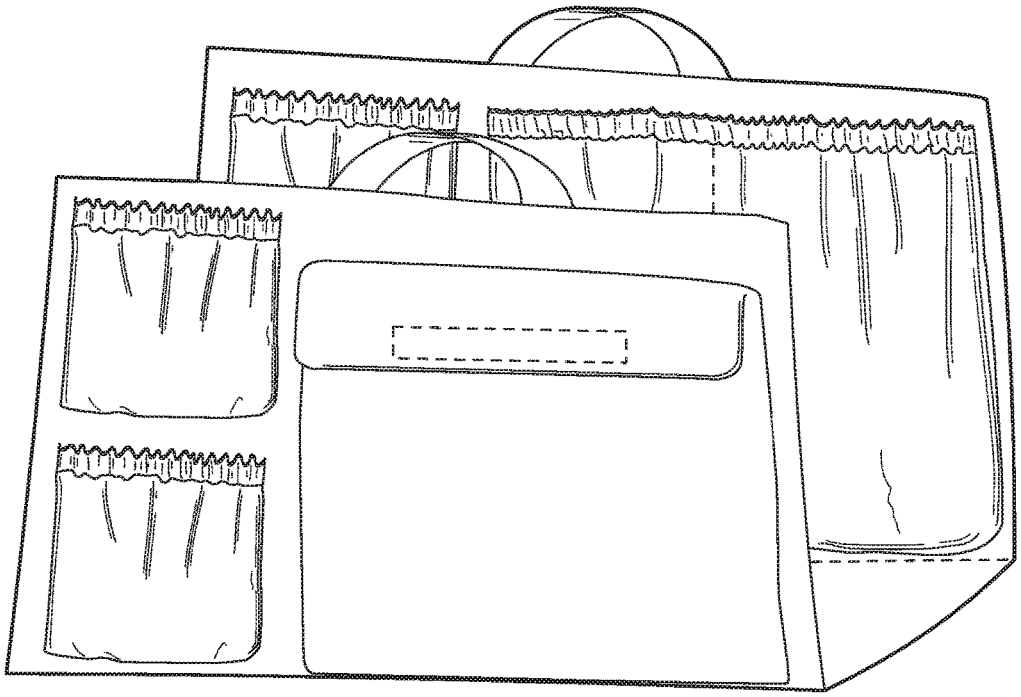
FIG. 21 shows a specific implementation of a handbag organizer insert having pockets on an inside of a first panel of the insert and pockets on an outside of a second panel.

FIG. 21 shows a specific implementation of a handbag organizer insert having pockets on an inside of a first panel of the insert and pockets on an outside of a second panel. The pockets can have different types of closures including elastic gathered edges, Velcro tabs, zippers, magnets, and others.

Figure 22:
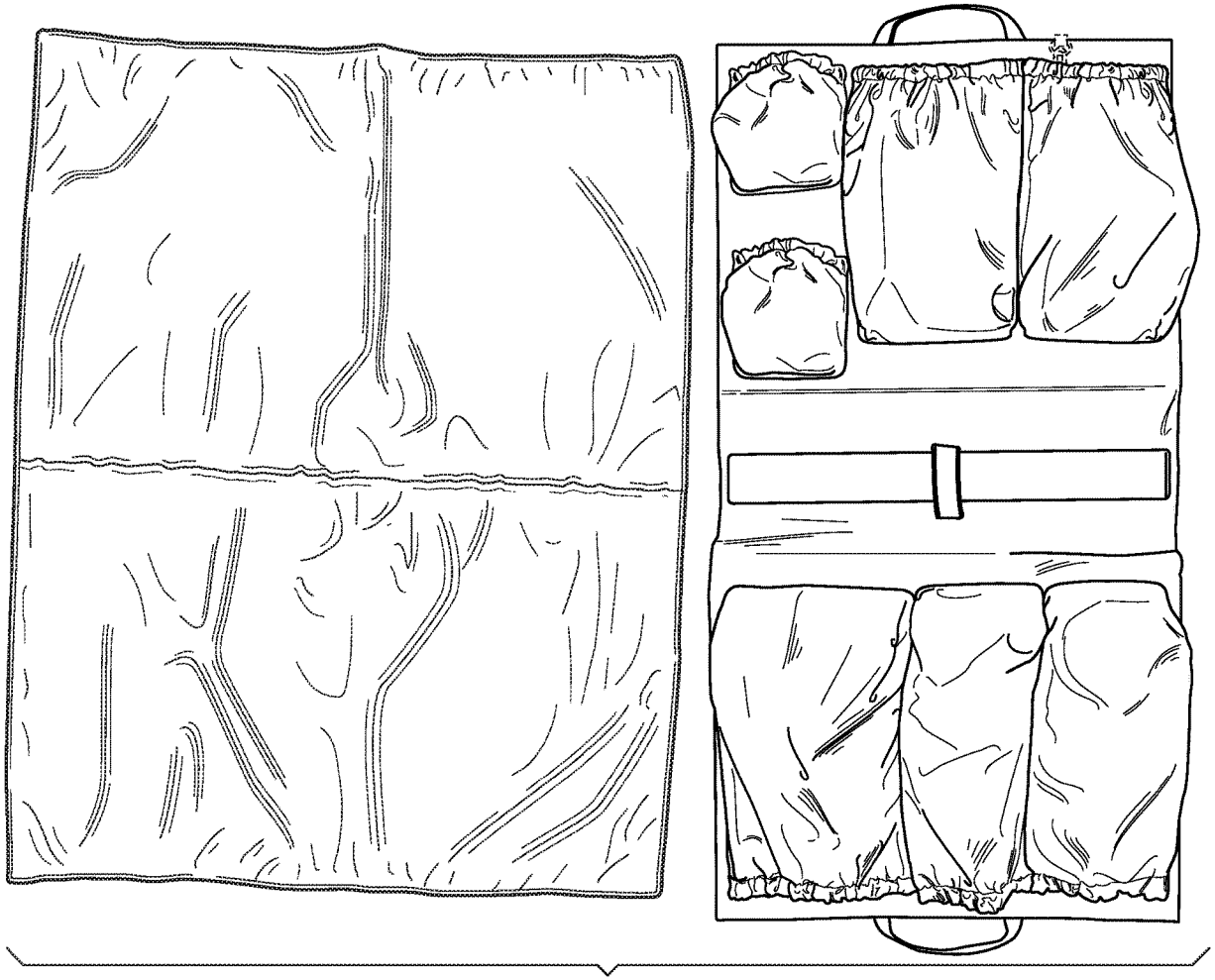
FIG. 22 shows an optional changing mat of an organizer laid flat.

FIG. 22 shows an optional changing mat of an organizer laid flat. When included, the mat can be rolled up and inserted into an elastic band positioned on a bottom panel of the organizer.

Referring to FIG. 17, a top elastic edging for pockets of the organizer includes a seam between two pockets separates the pockets.

FIGS. 10-11 show an organizer inserted into a handbag. In an implementation, an organizer in use in a handbag has a water bottle, keys, magazine, phone and snacks arranged in pockets of the organizer.

Figure 23:
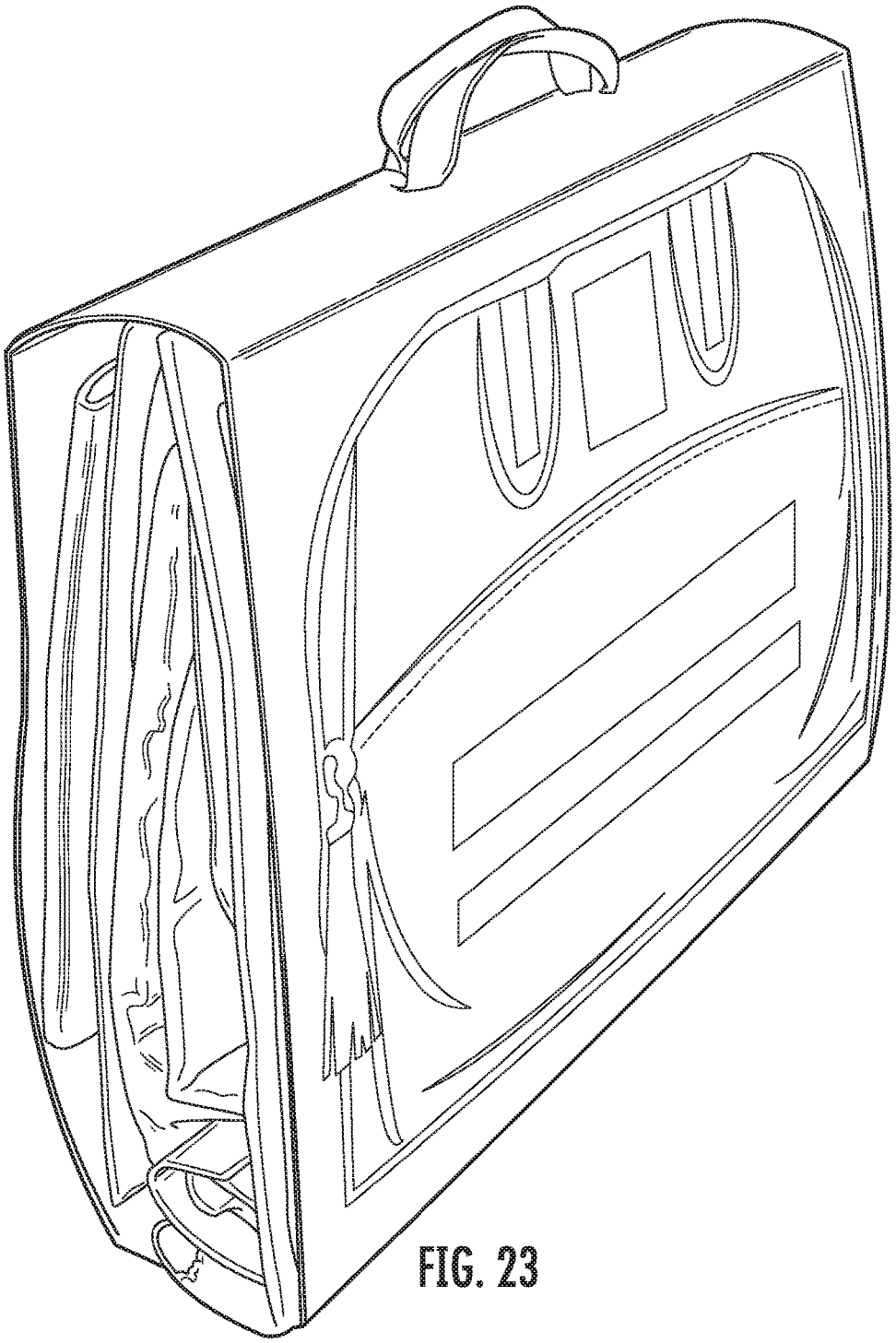
FIG. 23 shows an example of packaging for an organizer including a rectangular sleeve with a cutout portion from a top side of the sleeve.

FIG. 23 shows an example of packaging for an organizer including a rectangular sleeve with a cutout portion from a top side of the sleeve. The sleeve creates a compact case for the organizer for storage, while allowing a user to see the organizer from open ends on sides of the sleeve. There can be multiple packaging boxes for the organizer insert.

The packaging for the organizer can include a sleeve with a cutout on a top side of the sleeve. The organizer is inserted into the sleeve, and the handles can extend out from the cutout. The rectangular sleeve provides a sleek and condensed packaging for the organizer. The handles of the organizer exposed and extending through the cutout portion from the top side of the sleeve. This allows a user to grab and move the package easily.

Figure 24:
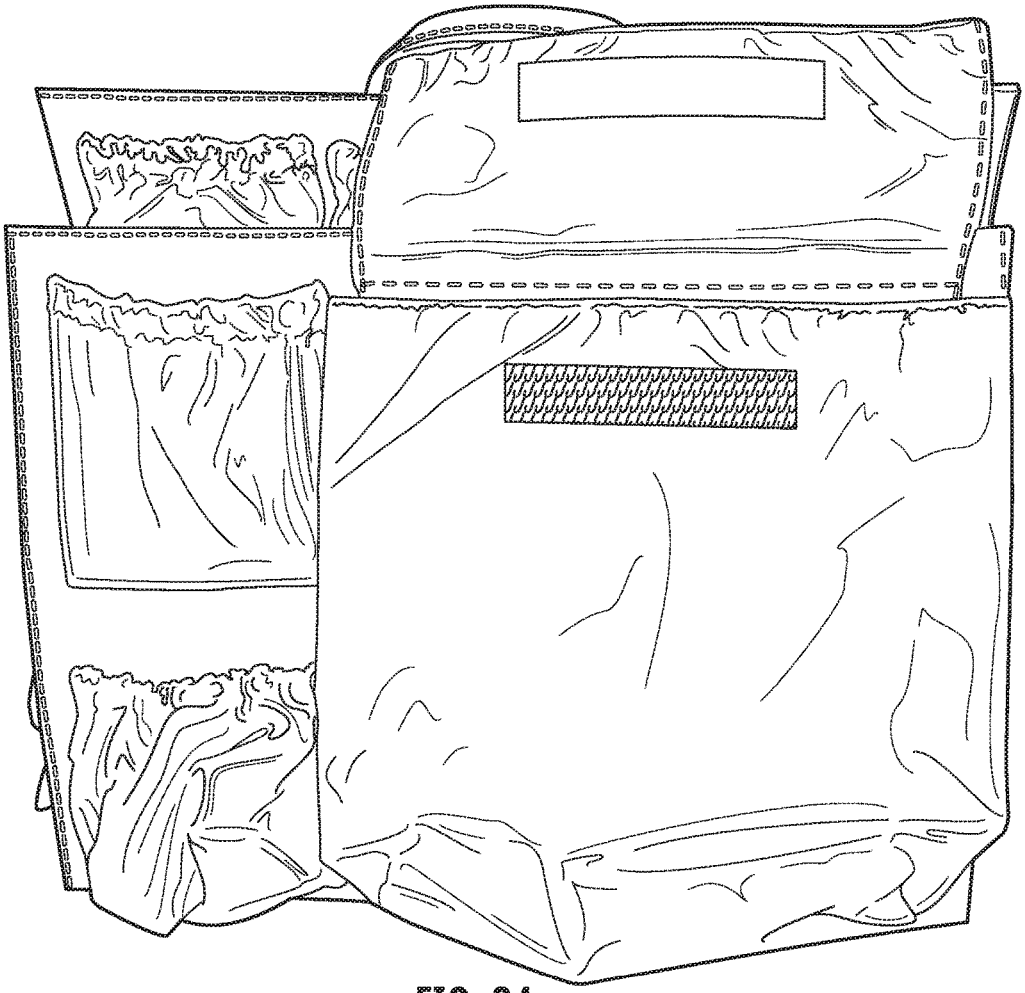
FIG. 24 shows a Velcro or hook-and-loop closure of an outside pocket of the organizer.

FIG. 24 shows a Velcro closure of an outside pocket of the organizer.

The pockets can have different color combinations. See also discussion below and table B. A first pocket on the left has an outer layer that is a brown color and a lining that is a pink color. A second pocket on the right has an outer layer that is pink and a lining that is pink. The lining layer is the same as or a lighter color relative to the outer layer to allow the inside of the pocket to be more bright and visible to a user. The user can see the contents more easily.

An organizer can omit the changing mat. An elastic band on a flat panel between the panels will also be omitted.

Figure 25:
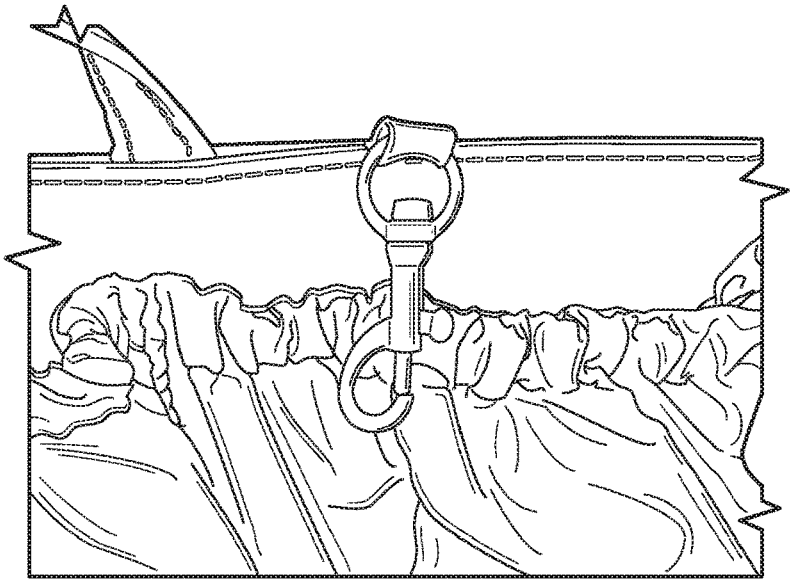
FIG. 25 shows an implementation of a key fob that includes a ring with a swivel spring-loaded key clasp (e.g., a trigger snap hook).

FIG. 25 shows an implementation of a key fob that includes a ring with a swivel spring-loaded key clasp (e.g., a trigger snap hook).

Figure 26:
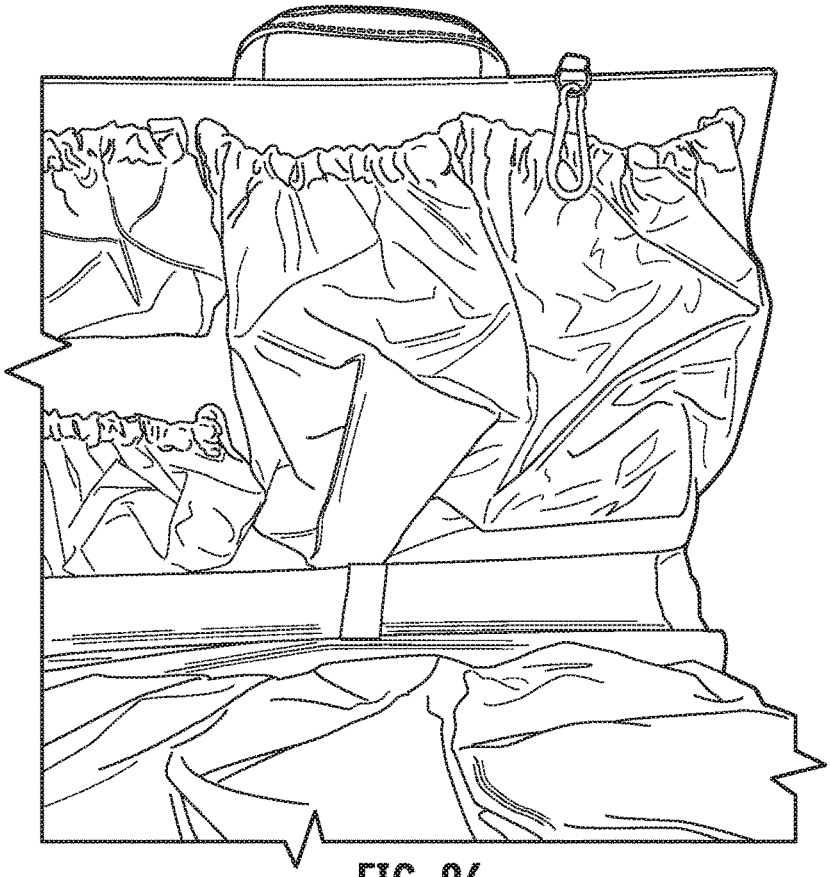
FIG. 26 shows an implementation of a key fob that includes a split ring with a carabiner.

FIG. 26 shows an implementation of a key fob that includes a split ring with a carabiner.

Figure 27:
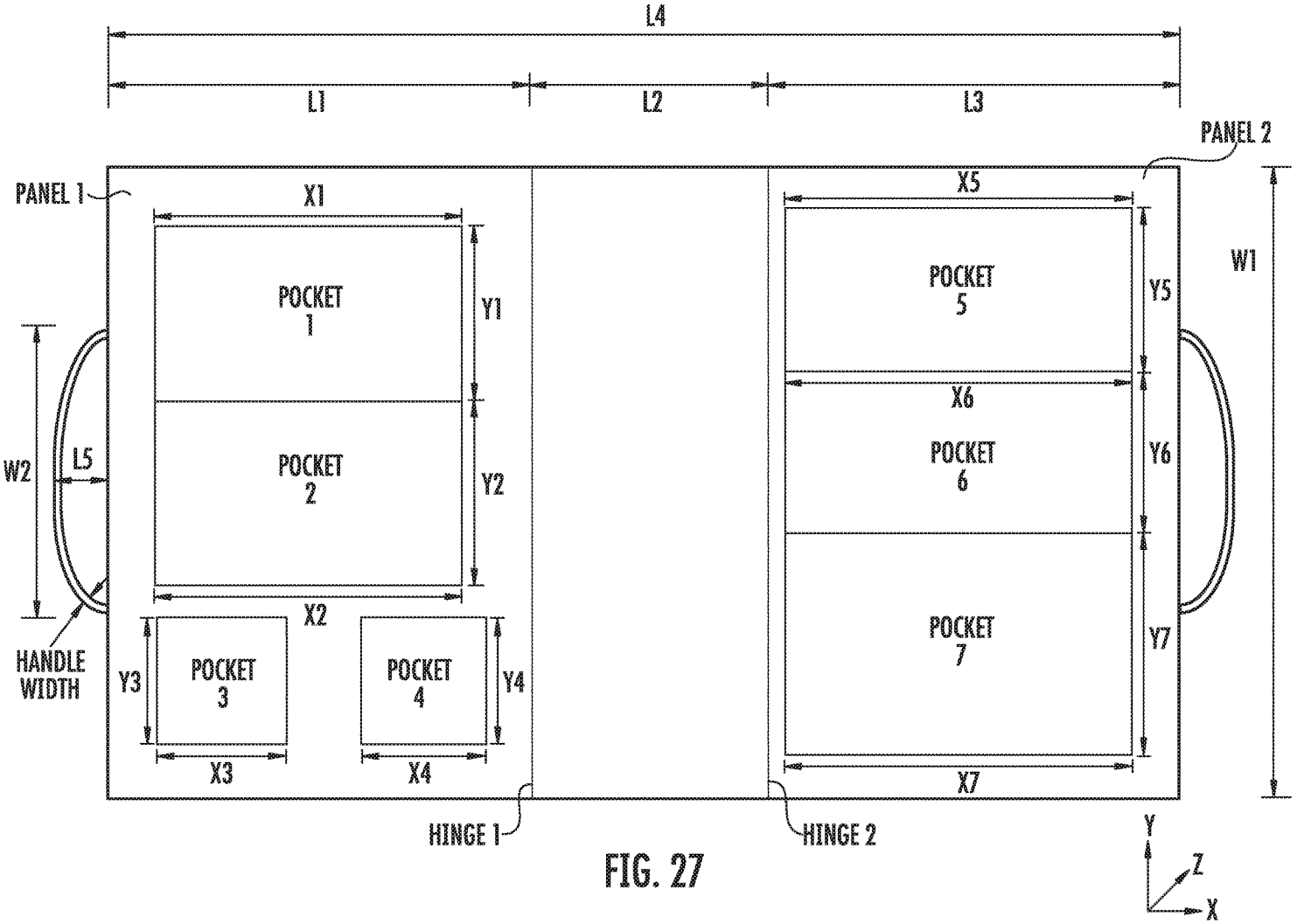
FIG. 27 shows a block diagram of a first side of an organizer with pockets.

FIG. 27 shows a block diagram of a first side of an organizer with pockets. The organizer includes a rectangular base with pockets connected to the base. The base includes two rigid panels sandwiched between two layers of material. The material is more flexible than the panels. The two layers of material extend between the two rigid panels where there are no rigid panels, and connect the two panels. H1 is an edge of a first panel, and H2 is an edge of a second panel. H1 and H2 form hinges about which the panels can rotate.

In a specific implementation, the first panel has a length from about 10.25 to about 10.5 inches and a width of about 14 inches. The second panel has the same dimensions as the first panel.

The panels include a stiff or rigid material (e.g., plastic sheet or cardboard). In a specific implementation, the material is polyethylene (e.g., a sheet of polyethylene) that is layered between two layers of nylon. To increase the rigidity, more than one layer of rigid material can be used. Two or more layer of polyethylene can be stacked and used for one panel. In other implementations, the rigid layer includes a cardboard material. And in other implementations, the rigid layer includes more than one kind of material. For example, the rigid layer can have a polyethylene layer and a cardboard layer.

Figure 34:
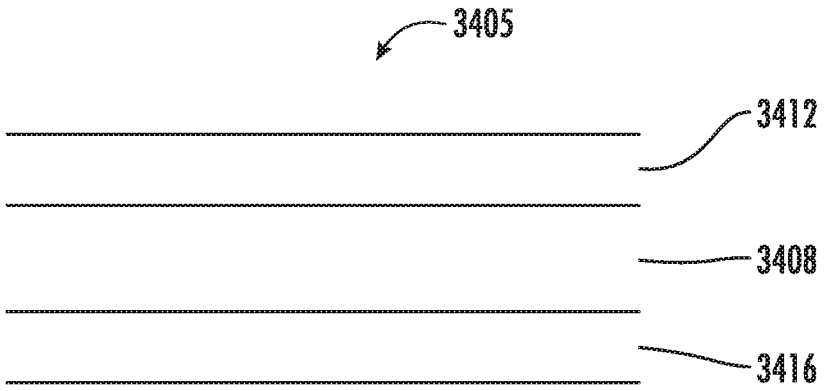
FIG. 34 shows a cross-sectional view of a first material of the handbag organizer insert.

FIG. 34 shows a cross-sectional view of a first material 3405 of the handbag organizer insert. The first material includes a sheet 3408 between a first layer 3412 and a second layer 3416. Sheet 3408 is more rigid than first layer 3412 and second layer 3416.

Figure 35:
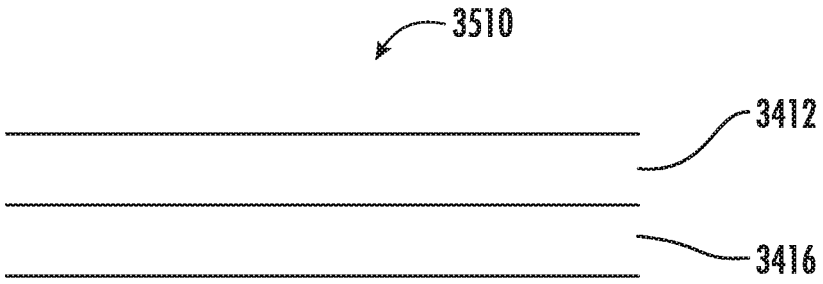
FIG. 35 shows a cross-sectional view of a second material of the handbag organizer insert.

FIG. 35 shows a cross-sectional view of a second material 3510 of the handbag organizer insert. The second material includes first layer 3412 and second layer 3416, without sheet 3408. In an implementation, the second material can include a first nylon layer (3412) and a second nylon layer (3416), without a polyethylene layer (3408) between them.

Figure 28:
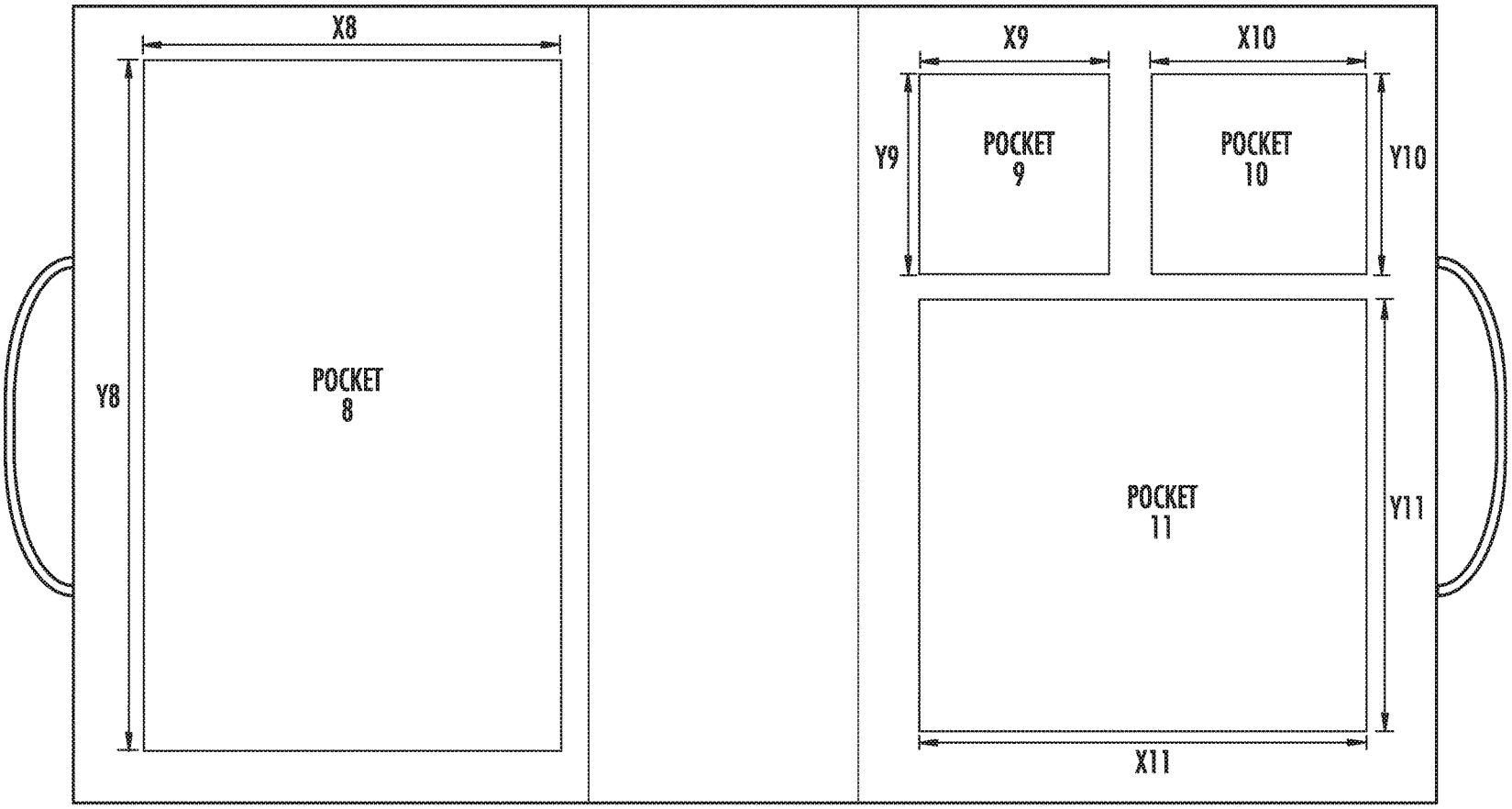
FIG. 28 shows a block diagram of a second side of the organizer with pockets.

When folded at H1 and H2, the first side will be on an inside of the organizer. FIG. 28 shows a block diagram of a second side of the organizer with pockets. When folded at H1 and H2, the second side will be on an outside of the organizer, opposite the inside.

Several dimensions are shown in FIGS. 27 and 28. Many other implementations are possible. These dimensions may vary depending on the age range of the child and the items needed. For example, organizers for newborns can have a larger pocket with a flap for used diaper storage, while one for a school age child can have more flat pockets for holding books and devices. Table A below shows several implementations for the organizer dimensions.

Each pocket includes a first dimension (X) in an x-axis, a second dimension (Y) in a y-axis, and a third dimension that is a depth measurement of the pocket in a Z-axis that is perpendicular to a plane formed by the X and Y axes. The measurements in Table 1 are approximate measurements. These measurements can vary by about 0.5 inch. For example, the X1 measurement for pocket 1 can vary from about 8 inches to about 9 inches. The dimensions in Table 1 can be increased for a larger size organizer insert (e.g., for a large size handbag, travel bag, or tote bag). Similarly, the dimensions can also be reduced for a smaller organizer (e.g., for a small purse, clutch bag, cosmetics bag, or pouch).

TABLE A

| Dimension | Implementation 1 (inches) | Implementation 2 (inches) | Implementation 3 (inches) |
|---|---|---|---|
| L1 | 26 | 10.25 | 10.25 |
| L2 | 14 | 5.5 | 5.5 |
| L3 | 5.5 | 10.25 | 10.25 |
| L4 | — | 26 | 26 |
| W1 | — | 14 | 14 |
| W2 | — | 4.5 | 4.75 |
| L5 | — | 1.5 | 1.5 |
| Handle width | — | 0.5 | 0.5 |
| X1 | 8.5 | 8.5 | 8.5 |
| Y1 | 5.5 | 4.5 | 4.5 |
| Pocket 1 depth | 3.25 | 2.75 | 2.75 |
| Pocket 1 volume (cubic inches) | 151.9 | 105.2 | 105.2 |
| X2 | 8.5 | 8.5 | 8.5 |
| Y2 | 4.5 | 4.5 | 4.5 |
| Pocket 2 Depth | 3.25 | 2.75 | 2.75 |
| Pocket 2 volume (cubic inches) | 124.3 | 105.2 | 105.2 |
| X3 | 4 | 3.75 | 3.75 |
| Y3 | 3.5 | 3.5 | 3.25 |
| Pocket 3 Depth | 2.5 | 2.5 | 2.5 |
| Pocket 3 volume (cubic inches) | 35 | 32.8 | 30.5 |
| X4 | 4 | 3.75 | 3.75 |
| Y4 | 3.5 | 3.5 | 3.25 |
| Pocket 4 Depth | 2.5 | 2.5 | 2.5 |
| Pocket 4 volume (cubic inches) | 35 | 32.8 | 30.5 |
| X5 | 9.5 | 9.5 | 9.5 |
| Y5 | 3.75 | 3.75 | 3.75 |
| Pocket 5 Depth | 3 | 3 | 3 |
| Pocket 5 volume (cubic inches) | 106.9 | 106.9 | 106.9 |
| X6 | 9.5 | 9.5 | 9.5 |
| Y6 | 3.75 | 3.75 | 3.75 |
| Pocket 6 Depth | 3 | 3 | 3 |
| Pocket 6 volume (cubic inches) | 106.9 | 106.9 | 106.9 |
| X7 | 9.5 | 9.5 | 9.5 |
| Y7 | 6.5 | 5.5 | 5.5 |
| Pocket 7 Depth | 3 | 3 | 3 |
| Pocket 7 volume (cubic inches) | 185.3 | 156.8 | 156.8 |
| X8 | 9.5 | 9.25 | 9.5 |
| Y8 | 14.5 | 12.75 | 13 |
| Pocket 8 Depth | flat (approximately 0.25) | flat (approximately 0.25) | flat (approximately 0.25) |
| Pocket 8 volume (cubic inches) | 34.4 | 29.5 | 30.9 |
| X9 | 4 | 3.75 | 4 |
| Y9 | 4 | 4 | 4 |
| Pocket 9 Depth | 3 | 3 | 3 |
| Pocket 9 volume (cubic inches) | 48 | 45 | 48 |
| X10 | 4.5 | 4.5 | 4.5 |
| Y10 | 4 | 4 | 4 |
| Pocket 10 Depth | flat (approximately 0.25) | flat (approximately 0.25) | flat (approximately 0.25) |
| Pocket 10 volume (cubic inches) | 4.5 | 4.5 | 4.5 |
| X11 | 9.5 | 9.5 | 9.5 |
| Y11 | 3.75 | 8.25 | 8.5 |
| Pocket 11 Depth | 3 | 3 | 3 |
| Pocket 11 volume (cubic inches) | 106.9 | 235.1 | 242.3 |

In a specific implementation, the organizer includes two handles as shown in FIG. 27. A handle has a length, along the y-axis, of about 4.75 inches, a handle drop of about 1.5 inches, and a handle width of about 0.5 inches. The handle drop is a measurement of the handle from a top edge of the organizer to a peak of the handle.

Each pocket includes two layers of nylon material that are sewn along the edges. A first layer is on an outside of the pocket and faces out. A second layer is on an inside of the pocket as a pocket lining.

In a specific implementation, pocket 5 includes a third layer between the first and second layers that is an insulating layer. The third layer includes a material that is different from the first and second layers. The material has good temperature retention properties. The third layer can include materials such as a foam material, polyethylene terephthalate (PET), synthetic microfiber, polyester, or other insulating materials. This pocket is adapted to be used to insulate a water or beverage bottle. In a specific implementation, the third layer includes a material that is freezable and reusable (e.g., in reusable cold packs, cold gel packs, and instant cold gel packs). Some examples of these include water, ammonium nitrate, propylene glycol, sodium carboxymethyl cellulose, hydroxpropyl methylcellulose, or silica gel.

In a specific implementation, pocket 8 (flat pocket on outside of organizer) includes a third layer between the first and second layers that is a rigid material, relative to the material of the first and second layers. The third layer can include a plastic material or a polyethylene material. The relatively rigid third layer can protect contents that may go into pocket 8 such as a tablet computer or other electronic device. In an implementation, the third layer includes a perforated plastic sheet. The perforations can provide ventilation for an electronic device to prevent it from over heating in the organizer.

In a specific implementation, the organizer includes a changing mat that can be rolled up and held in place by an elastic band positioned on a bottom panel between the first and second panels. The mat is made of two layers of nylon material having about the same dimensions sewn together along edges of the two layers.

The first and second layers of material can have the same or different color material. For example, a pocket can have a first color (or main color) on an outside, and a second color (or lining color) on the inside of the pocket.

As described above, the base is sandwiched between two layers of material. This material can have the first color to match the pockets with the first color on the outside of the pockets.

Table B below shows several implementations for the colors for each pocket. A represents a first color and B represents a second color that is different from A.

TABLE B

| Pocket | Implementation | Main Outside Color | Lining Color |
|---|---|---|---|
| 1 | 1 | A | B |
| | 2 | A | A |
| | 3 | B | A |
| | 4 | B | B |
| 2 | 5 | A | B |
| | 6 | A | A |
| | 7 | B | A |
| | 8 | B | B |
| 3 | 9 | A | B |
| | 10 | A | A |
| | 11 | B | A |
| | 12 | B | B |
| 4 | 13 | A | B |
| | 14 | A | A |
| | 15 | B | A |
| | 16 | B | B |

TABLE B-continued

| Pocket | Implementation | Main Outside Color | Lining Color |
|---|---|---|---|
| 5 | 17 | A | B |
| | 18 | A | A |
| | 19 | B | A |
| | 20 | B | B |
| 6 | 21 | A | B |
| | 22 | A | A |
| | 23 | B | A |
| | 24 | B | B |
| 7 | 25 | A | B |
| | 26 | A | A |
| | 27 | B | A |
| | 28 | B | B |
| 8 | 29 | A | B |
| | 30 | A | A |
| | 31 | B | A |
| | 32 | B | B |
| 9 | 33 | A | B |
| | 34 | A | A |
| | 35 | B | A |
| | 36 | B | B |
| 10 | 37 | A | B |
| | 38 | A | A |
| | 39 | B | A |
| | 40 | B | B |
| 11 | 41 | A | B |
| | 42 | A | A |
| | 43 | B | A |
| | 44 | B | B |

In a specific implementation, pockets 1, 2, 4, 6, 7, 9, 10, and 11 have color A as an outside color, and color B as an inner lining color. Color A is a brown (or coffee) color, and color B is a pink (or magenta) color. Pockets 3, 5, and 8 have color B as an outside color, and color A as an inside color. The base material includes color A (brown or coffee-colored).

In a specific implementation, an organizer pockets with the inside lining of the pockets in a first color, and the outside layer of the pockets include a second color. The first color is a lighter color than the second color. The pockets are lined with a lighter color to allow the user to see objects (e.g., coins, dirt, or lint) inside the pocket more easily and clearly.

The organizer includes a changing mat that can be rolled and inserted into an elastic band holder that is connect to the material between the first and second panels. In a specific implementation, the mat is made of a material that is in color B (magenta).

An opening of a pocket includes an edge that includes an elastic band sewn between the first and second layers of material. The elastic edge can prevent items from falling out of the pockets.

In a specific implementation, pockets 1-7 and 9-11 have an elastic band edge while pocket 8 does not have an elastic band. Pocket 8 is a flat pocket with a flat edge that lies against the base of the organizer. Pockets 1-7 and 9-11 each have a gathered top edge, at its opening, where the pocket material (e.g., nylon) is gathered (or pleated, folded, or ruched) along a length of an elastic band or cord that runs (e.g., in a channel) between the inner and outer layers of material. The gathered edge forms an elastic cuff for the pocket around the opening to prevent items from falling out. In a specific implementation, the pocket top includes a fluted edge.

In a specific implementation, before a pocket is attached to the base of the organizer, a first seam is sewn through the first and second layers of a pocket near an upper edge of a pocket, closest to the opening side. Between the first seam and a second seam, along an upper edge of the pocket, is a casing (or tube) formed between the first and second layers with a first and second open ends. An elastic piece (e.g., band or cord) is inserted into the first open end and threaded through to the second open end of the casing. The pocket material is gathered or bunched up along the length of the elastic so that when the elastic stretches, the pocket material will extend with the elastic. A third seam is sewn, along the first and second ends, and along edges of the pocket, through the pocket and the first layer of base material.

In another specific implementation, an elastic thread or string is used at the top edge to create an elastic edge around the opening of a pocket. A shirring technique using the elastic string is used to create gathers in the pocket material at the top edge.

Figure 29:
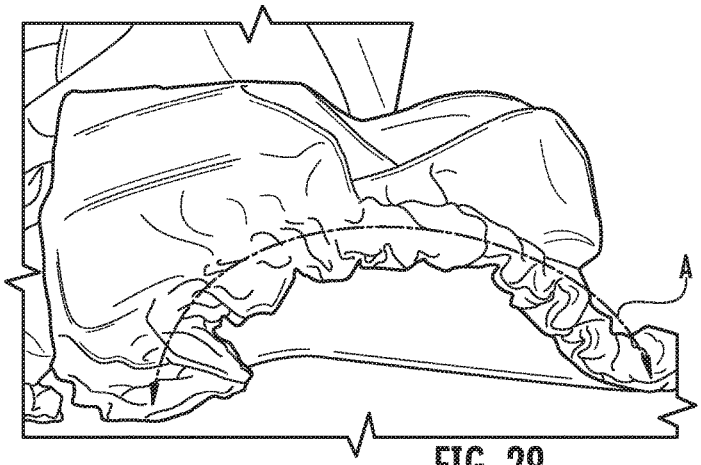
FIGS. 29-31 show some views of pocket 3.
Figure 30:
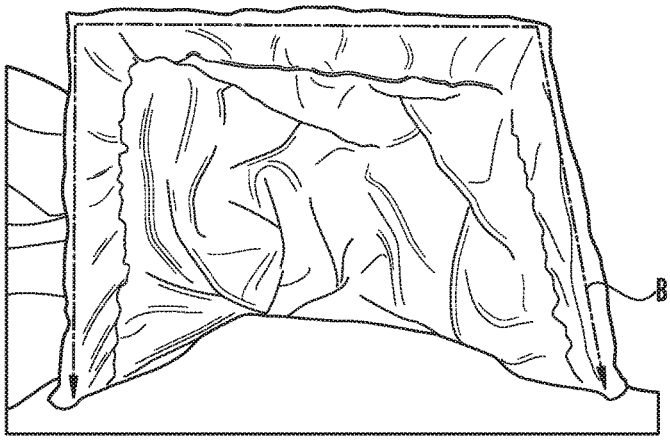
Figure 31:
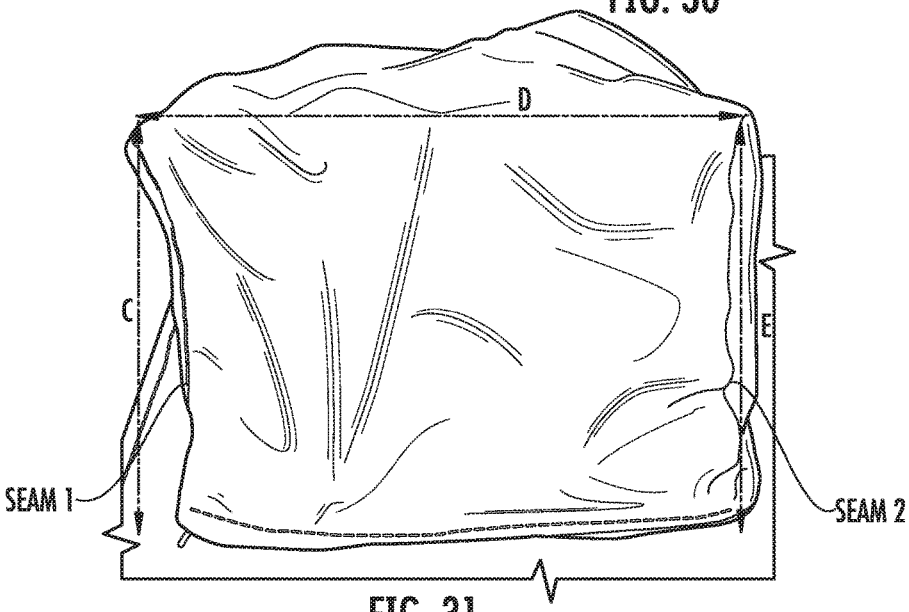

FIGS. 29-31 show some views of pocket 3. FIG. 29 shows a non-stretched or unstretched opening of the pocket with a length A of the gathered edge. FIG. 30 shows a stretched opening having a length B. And FIG. 31 shows a pocket base with sides C, D, and E. There are two seams formed in the base, seam 1 and 2. The length of A is less than the length of B, and A is less than a sum of C+D+E. D is less or the same as the sum C+D+E. In an implementation, D is greater than the sum of C+D+E.

Figure 32:
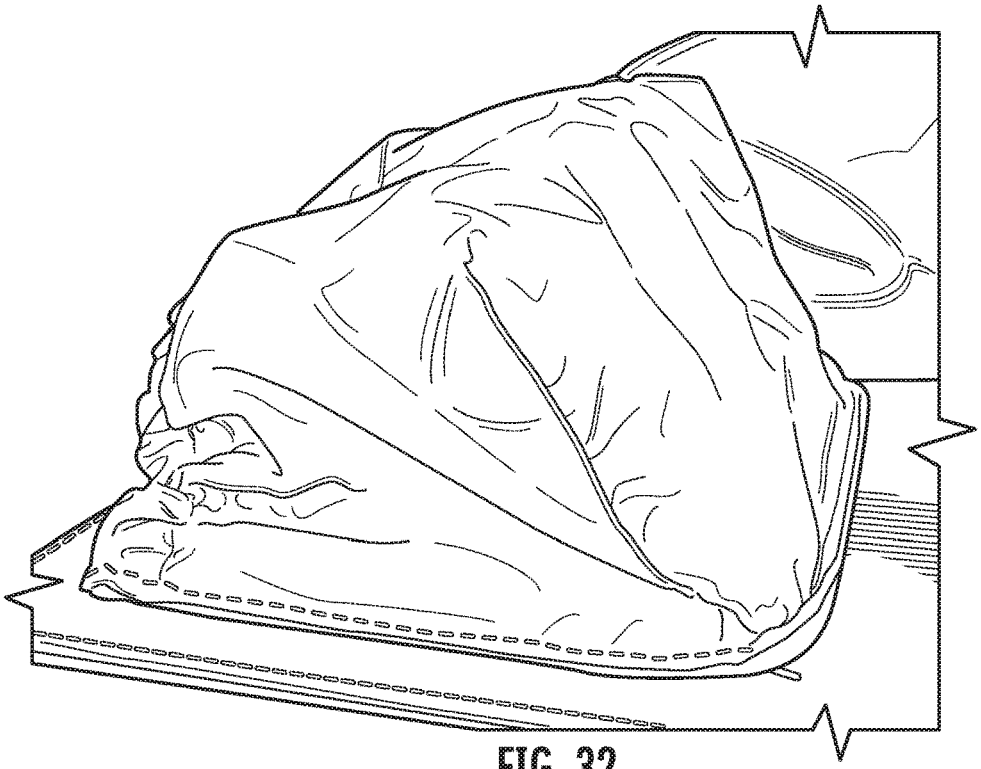
FIG. 32 shows a detailed view of seam 1 of the base.
Figure 33:
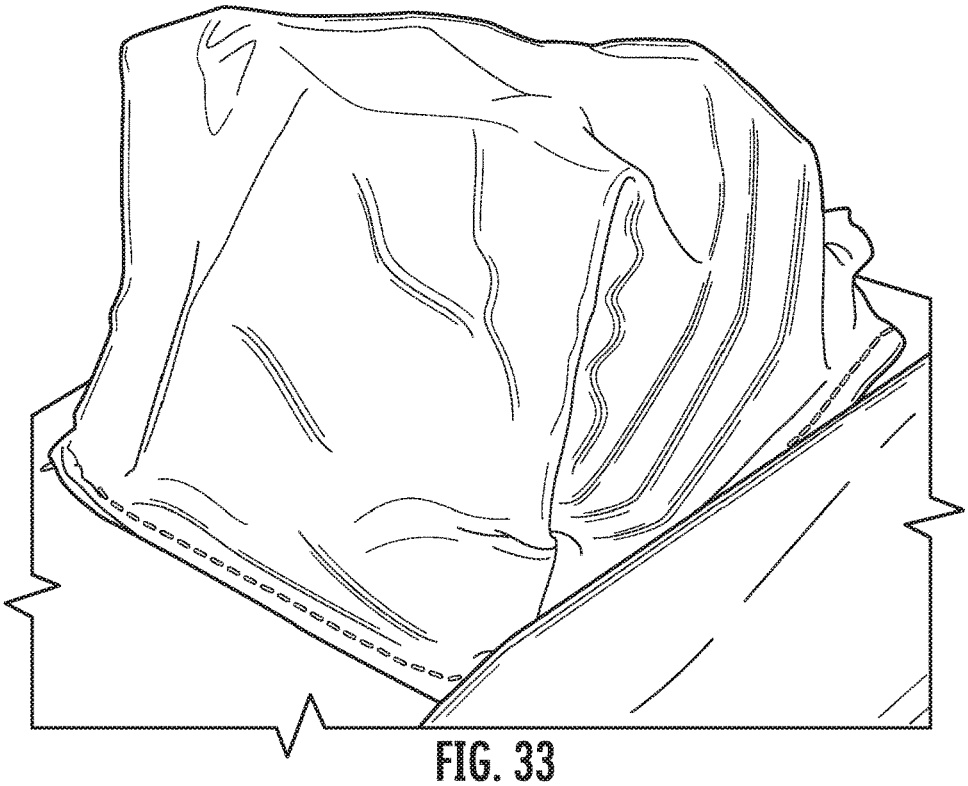
FIG. 33 shows seam 2 of the base.

FIG. 32 shows a detailed view of seam 1 of the base, and FIG. 33 shows seam 2 of the base.

In a specific implementation, A is about 4 inches, B is about 8 inches, C has a length of about 2.5 inches, D has a length of about 3.5 inches, and E has a length of about 2.5 inches. In a specific implementation, pockets 1-7 and 9-11 each has a pocket base, while pocket 8 is a flat pocket.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. An apparatus comprising:

a first panel, wherein the first panel comprises a first material and a first surface and a second surface, and the first and second surfaces comprise pockets;

a second panel, wherein the second panel comprises the first material and a third surface and a fourth surface, and the third and fourth surfaces comprise pockets;

a flexible base portion, wherein the base portion comprises a second material, the second material is more flexible than the first material, and the base portion does not comprise pockets, bottom sides of the first panel and second panel are coupled together via the flexible base portion, and side edges of the first panel and second panel that are transverse to bottom edges of the first and second panels are not coupled together, the second material comprises a first nylon layer and a second nylon layer, without a polyethylene layer between them, in an open position, via the flexible base portion, the first and second panels are rotated and positioned in a relatively flat orientation with respect to each other, whereby while in the open position, the first and second panels can be placed and laid against a relatively flat surface, and in an upright position, via the flexible base portion, the first and second panels are rotated and positioned in a relatively upright orientation with respect to the open position, whereby while in the upright position, the first and second panels can be inserted into a handbag and are positioned against sides of the handbag while still allowing access to the pockets on the first, second, third and fourth surfaces, in the upright position, the second and third surfaces face each other, while the first and fourth surface face away from each other each pocket of the second surface of the first panel comprises an opening and three closed sides that are coupled to the first panel, and the opening is positioned facing away from the base portion, and each pocket of the third surface of the second panel comprises an opening and three closed sides that are coupled to the second panel, and the opening is positioned facing away from the base portion, whereby while in the upright position in a handbag, the pockets of second and third surfaces can hold an item without that item falling into the base panel, which is positioned against a bottom of the handbag.

2. The apparatus of claim 1 wherein the base portion comprises an elastic band holder, the apparatus comprises a mat that is rolled up and inserted into the elastic band holder.

3. The apparatus of claim 1 wherein the second surface comprises a first pocket comprising an elastic band that is sewn between first and second layers of the first material at a top edge of the first pocket, wherein the elastic band of the top edge of the pocket allows an opening for the pocket to be enlarged by elastically stretching and to return to its original size by elastically contracting.

4. The apparatus of claim 1 wherein the fourth surface comprises a first pocket comprising a flap top, comprising a hook-and-loop-type closure.

5. The apparatus of claim 1 wherein the second surface comprises a first pocket, second pocket, third pocket, the first pocket is positioned above the second pocket, the third pocket is positioned besides the first and second pockets, and a length of the third pocket extends from at least a top of the first pocket to a bottom of the second pocket, and in the upright position, the openings of the first pocket, second pocket, and third pocket face way from the base panel and extend along lines parallel to a bottom edge of the first panel that is coupled to the flexible base portion.

6. The apparatus of claim 1 wherein the third surface comprises a first pocket comprising an insulation layer and a second pocket not comprising the insulation layer.

7. The apparatus of claim 1 wherein an upper edge of the first panel comprises a first handle and an upper edge of the second panel comprises a second handle, and when in the upright position, a person's hand can be placed through openings of both the first and second handles.

8. The apparatus of claim 1 wherein the first material comprises a polyethylene layer between a first nylon layer and a second nylon layer.

9. An apparatus comprising:

a first panel, wherein the first panel comprises a first material and a first surface and a second surface, and the first and second surfaces comprise pockets;

a second panel, wherein the second panel comprises the first material and a third surface and a fourth surface, and the third and fourth surfaces comprise pockets;

a flexible base portion, wherein the base portion comprises a second material, the second material is more flexible than the first material, and the base portion does not comprise pockets, in an open position, via the flexible base portion, the first and second panels are rotated and positioned in a relatively flat orientation with respect to each other, whereby while in the open position, the first and second panels can be placed and laid against a relatively flat surface, in an upright position, via the flexible base portion, the first and second panels are rotated and positioned in a relatively upright orientation with respect to the open position, whereby while in the upright position, the first and second panels can be inserted into a handbag and are positioned against sides of the handbag while still allowing access to the pockets on the first, second, third and fourth surfaces, in the upright position, the second and third surfaces face each other, while the first and fourth surface face away from each other, and the flexible base portion allows a distance between a lower edge of the first and second panels to be adjusted to be closer or further apart from each other, the second surface comprises a first pocket, second pocket, third pocket, the first pocket is positioned above the second pocket, the third pocket is positioned besides the first and second pockets, and a length of the third pocket extends from at least a top of the first pocket to a bottom of the second pocket, the first material comprises a sheet between a first layer and a second layer, the sheet is more rigid than the first and second layers, and the second material comprises the first layer and the second layer, without the sheet, each pocket of the second surface of the first panel comprises an opening and three closed sides that are coupled to the first panel, and the opening is positioned facing away from the base portion and extends along a line parallel to a bottom edge of the first panel that is coupled to the flexible base portion, and each pocket of the third surface of the second panel comprises an opening and three closed sides that are coupled to the second panel, and the opening is positioned facing away from the base portion and extends along a line parallel to a bottom edge of the second panel that is coupled to the flexible base portion.

10. The apparatus of claim 9 wherein the third surface comprises a fourth pocket comprising an insulation layer, and a fifth pocket not comprising the insulation layer.

11. The apparatus of claim 9 wherein the fourth surface comprises a fourth pocket comprising a flap top, comprising a hook-and-loop-type closure.

12. The apparatus of claim 9 wherein each of the first, second, and third pockets comprises an elastic cuff at an opening edge of the pocket, and the elastic cuff of the opening edge of the pocket allows an opening for the pocket to be enlarged by elastically stretching and to return to its original size by elastically contracting.

13. A method comprising:

forming a first panel of an organizer insert comprising a first layer, second layer, and third layer, wherein the first layer and second layer comprise a first material and the third layer comprises a second material that is more rigid than the first material, and the first panel has first and second surfaces;

forming a second panel comprising the first layer, second layer, and third layer, wherein the second panel has third and fourth surfaces;

forming pockets on the first, second, third, and fourth surfaces;

coupling the first panel to the second panel through a flexible base portion, wherein the base portion comprises the first material and not the second material;

for an open position, via the flexible base portion, allowing the first and second panels to be rotated and positioned in a relatively flat orientation with respect to each other, whereby while in the open position, the first and second panels can be placed and laid against a relatively flat surface;

for an upright position, via the flexible base portion, allowing the first and second panels to be rotated and positioned in a relatively upright orientation with respect to the open position, whereby while in the upright position, the first and second panels can be inserted into a handbag and are positioned against sides of the handbag while still allowing access to the pockets on the first, second, third and fourth surfaces, wherein in the upright position, the second and third surfaces face each other, while the first and fourth surface face away from each other each pocket of the second surface of the first panel comprises an opening and three closed sides that are coupled to the first panel, the opening is positioned facing away from the base portion, and each pocket of the third surface of the second panel comprises an opening and three closed sides that are coupled to the second panel, and the opening is positioned facing away from the base portion.

14. The method of claim 13 wherein the second surface comprises a first pocket, second pocket, third pocket, the first pocket is positioned above the second pocket, the third pocket is positioned besides the first and second pockets, and a length of the third pocket extends from at least a top of the first pocket to a bottom of the second pocket.

15. The method of claim 14 comprising:

for each of the first, second, and third pockets, forming an elastic cuff at a top edge of each pocket, wherein the elastic cuff of the top edge of each pocket allows an opening for each pocket to be enlarged by elastically stretching and to return to its original size by elastically contracting.

16. The method of claim 13 comprising:

forming a first pocket on the third surface comprising a third material, wherein the third material comprising an insulating layer; and forming a second pocket on the third surface not comprising the insulation layer.

17. The method of claim 13 comprising:

forming a first handle on a first edge of the first panel;

forming a second handle on a second edge of the second panel, wherein the second edge is opposite of the first edge when the organizer insert is in the open position, and when in the upright position, a person's hand can be placed through openings of both the first and second handles, whereby the person can carry the organizer insert by way of the handles, wherein bottom edges of the first and second panels are coupled together via the flexible base portion, side edges of the first and second panels that are transverse to bottom edges of the first and second panels are not coupled together, forming open sides for the organizer insert while in the handbag, and upper edges of the first panel and second panel are not coupled together, forming an open top for the organizer insert while in the handbag.

18. The method of claim 13 wherein dimensions of the first panel are the same as dimensions of the second panel.

19. An apparatus comprising:

a first panel, wherein the first panel comprises a first material and a first surface and a second surface, and the first and second surfaces comprise pockets;

a second panel, wherein the second panel comprises the first material and a third surface and a fourth surface, and the third and fourth surfaces comprise pockets, and an upper edge of the first panel comprises a first handle and an upper edge of the second panel comprises a second handle, and when in the upright position, a person's hand can be placed through openings of both the first and second handles;

a flexible base portion, wherein the base portion comprises a second material, the second material is more flexible than the first material, and the base portion does not comprise pockets, in an open position, via the flexible base portion, the first and second panels are rotated and positioned in a relatively flat orientation with respect to each other, whereby while in the open position, the first and second panels can be placed and laid against a relatively flat surface, and in an upright position, via the flexible base portion, the first and second panels are rotated and positioned in a relatively upright orientation with respect to the open position, whereby while in the upright position, the first and second panels can be inserted into a handbag and are positioned against sides of the handbag while still allowing access to the pockets on the first, second, third and fourth surfaces, in the upright position, the second and third surfaces face each other, while the first and fourth surface face away from each other each pocket of the second surface of the first panel comprises an opening and three closed sides that are coupled to the first panel, and the opening is positioned facing away from the base portion, and each pocket of the third surface of the second panel comprises an opening and three closed sides that are coupled to the second panel, and the opening is positioned facing away from the base portion, whereby while in the upright position in a handbag, the pockets of second and third surfaces can hold an item without that item falling into the base panel, which is positioned against a bottom of the handbag.

20. The apparatus of claim 19 wherein bottom sides of the first panel and second panel are coupled together via the flexible base portion, and side edges of the first panel and second panel that are transverse to bottom edges of the first and second panels are not coupled together.

21. The apparatus of claim 20 wherein the second material comprises a first nylon layer and a second nylon layer, without a polyethylene layer between them.

22. The apparatus of claim 19 wherein the base portion comprises an elastic band holder, the apparatus comprises a mat that is rolled up and inserted into the elastic band holder.

23. The apparatus of claim 19 wherein the second surface comprises a first pocket comprising an elastic band that is sewn between first and second layers of the first material at a top edge of the first pocket, wherein the elastic band of the top edge of the pocket allows an opening for the pocket to be enlarged by elastically stretching and to return to its original size by elastically contracting.

24. The apparatus of claim 19 wherein the fourth surface comprises a first pocket comprising a flap top, comprising a hook-and-loop-type closure.

25. The apparatus of claim 19 wherein the second surface comprises a first pocket, second pocket, third pocket, the first pocket is positioned above the second pocket, the third pocket is positioned besides the first and second pockets, and a length of the third pocket extends from at least a top of the first pocket to a bottom of the second pocket, and in the upright position, the openings of the first pocket, second pocket, and third pocket face way from the base panel and extend along lines parallel to a bottom edge of the first panel that is coupled to the flexible base portion.

26. The apparatus of claim 19 wherein the third surface comprises a first pocket comprising an insulation layer and a second pocket not comprising the insulation layer.

27. The apparatus of claim 19 wherein the first material comprises a polyethylene layer between a first nylon layer and a second nylon layer.

* * * * *